US011391449B1

(12) United States Patent
Takayama et al.

(10) Patent No.: US 11,391,449 B1
(45) Date of Patent: Jul. 19, 2022

(54) ADJUSTABLE MOUNTED PORTABLE LIGHT

(71) Applicant: Logitech Europe S.A., Lausanne (CH)

(72) Inventors: Steven Ryutaro Takayama, Menlo Park, CA (US); Giuseppe Russo, Redwood City, CA (US); Arnaud Daniel Perret-Gentil, Oakland, CA (US); Jasmine Madeline Apolinar, Hollister, CA (US)

(73) Assignee: LOGITECH EUROPE S.A., Lausanne (CH)

( * ) Notice: Subject to any disclaimer, the term of this patent is extended or adjusted under 35 U.S.C. 154(b) by 0 days.

(21) Appl. No.: 17/355,431

(22) Filed: Jun. 23, 2021

(51) Int. Cl.

| | |
|---|---|
| ***F21V 21/14*** | (2006.01) |
| ***F21V 21/088*** | (2006.01) |
| ***F21V 17/02*** | (2006.01) |
| ***F21V 21/30*** | (2006.01) |
| ***F21V 21/26*** | (2006.01) |
| *F21Y 113/10* | (2016.01) |
| *F21V 21/22* | (2006.01) |

(52) U.S. Cl.
CPC ..... *F21V 21/088* (2013.01); *F21V 17/02* (2013.01); *F21V 21/26* (2013.01); *F21V 21/30* (2013.01); *F21V 21/22* (2013.01); *F21Y 2113/10* (2016.08)

(58) Field of Classification Search
CPC ..... F21V 21/14; F21V 21/22; F21V 21/26; F21V 21/28; F21V 21/29; F21V 21/30; F21V 21/12; F21V 21/088; F21V 17/02; F21Y 2113/10
See application file for complete search history.

(56) References Cited

U.S. PATENT DOCUMENTS

| | | | | |
|---|---|---|---|---|
| 4,803,606 | A * | 2/1989 | Rotter | F21V 21/14 362/427 |
| 5,424,931 | A * | 6/1995 | Wheeler | F21V 21/14 362/418 |
| 5,855,343 | A | 1/1999 | Krekelberg | |
| 6,418,010 | B1 | 7/2002 | Sawyer | |
| 6,738,094 | B1 | 5/2004 | Minami et al. | |
| 7,066,664 | B1 | 6/2006 | Sitoh et al. | |
| D554,682 | S | 11/2007 | Martinez et al. | |
| D563,446 | S | 3/2008 | Stephens et al. | |
| D564,559 | S | 3/2008 | Stephens et al. | |
| 7,431,253 | B2 | 10/2008 | Yeh | |
| D579,967 | S | 11/2008 | Jones et al. | |
| 7,572,073 | B2 | 8/2009 | Kenoyer et al. | |
| 7,618,202 | B2 | 11/2009 | Xiao et al. | |
| 7,775,486 | B2 | 8/2010 | Depay et al. | |

(Continued)

*Primary Examiner* — Y M. Quach Lee
(74) *Attorney, Agent, or Firm* — Patterson & Sheridan, LLP

(57) ABSTRACT

A mount includes a first linkage having a front face that extends in a first direction and faces in a second direction that is perpendicular to the first direction, a second linkage slidably connected to the first linkage, the second linkage comprising a body portion extending in the first direction and a neck portion disposed at an end of the body portion of the second linkage, a third linkage rotatably connected to the first linkage at a first end of the third linkage, a telescoping element slidably connected to the third linkage, the telescoping element comprising an abutment portion at an end of the telescoping element, and a housing attachment mechanism coupled to a first surface of the neck portion of the second linkage.

20 Claims, 18 Drawing Sheets

(56) References Cited

U.S. PATENT DOCUMENTS

| | | | |
|---|---|---|---|
| 7,931,243 | B2 | 4/2011 | Yim et al. |
| 9,169,962 | B2 | 10/2015 | Wang et al. |
| 2007/0212057 | A1 | 9/2007 | Liang |
| 2011/0243548 | A1 | 10/2011 | Khamsepoor et al. |

* cited by examiner

ADJUSTABLE MOUNTED PORTABLE LIGHT

BACKGROUND

Field

Embodiments of the present disclosure generally relate to a mountable device assembly, and more particularly, to a mountable lighting device assembly.

Description of the Related Art

Remote video conferencing and live streaming has become more popular in recent years, due in large part to the declining costs of video generating equipment, the proliferation of high-speed Internet, and a global movement towards remote work situations. As familiarity with remote video conferencing and live streaming increases, so does demand for more sophisticated camera devices, such as a webcam, and adequate lighting to properly capture images. A light source for proper image capturing may not be readily available, or may be large, heavy, and inconvenient for the use in remote video conferencing conducted on a laptop, a tablet, or other portable electronics devices. Thus, a portable light that can be positioned with a webcam has become a common demand for video conference users.

However, for proper lighting, a location of a portable light needs to be adjusted in relation to other objects, such as a screen of a computer monitor, a user with or without glasses that is positioned in a remote video conference environment, other light sources, and/or walls near the computer monitor. For example, if a portable light is positioned in an inappropriate position above or on a side of a user that is wearing glasses, a captured image may contain glare from the glasses. If a portable light is positioned on one side of a user, a captured image may include undesirable shadows on an opposing side of the user. If a portable light is positioned in front of a screen of a computer monitor, a captured image and/or the computer screen itself may contain glare generated by the light source in the portable light. If a portable light is positioned in front of the lens of a camera device, a captured image may contain "lens flare" due to the light source in the portable light being in or near the field of view of the camera device. Lens flare is typically caused when stray light reaches the sensor in the camera due to reflections at the air-glass interface of the lens or due to light scattering in the lens. Such glare may also cause eye strain for a user.

Accordingly, there is a need in the art for a light source that has a mount that is adjustable and configurable to allow the light source to be mounted and positioned, in any possible video conferencing or livestreaming environment, so that the light source avoids the problems described above.

SUMMARY

Embodiments of the disclosure provide a device mount. The device mount includes a first linkage having a front face that extends in a first direction and faces in a second direction that is perpendicular to the first direction, a second linkage slidably connected to the first linkage, the second linkage comprising a body portion extending in the first direction and a neck portion disposed at an end of the body portion of the second linkage, a third linkage rotatably connected to the first linkage at a first end of the third linkage, a telescoping element slidably connected to the third linkage, the telescoping element comprising an abutment portion at an end of the telescoping element, and a housing attachment mechanism coupled to a first surface of the neck portion of the second linkage. The body portion includes a front face that faces the second direction, and a rear face opposite to the front face in the second direction, and the neck portion is inclined at an angle with respect to the front face of the body portion, where the angle is measured about a third axis that is substantially perpendicular to the first direction. The third linkage extends outwardly from the front face of the first linkage.

Embodiments of the disclosure also provide a mountable device assembly. The mountable device assembly includes a device mount, a housing disposed on the device mount via the housing attachment mechanism, and a device enclosed in the housing. The device mount includes a first linkage having a front face that extends in a first direction and faces in a second direction that is perpendicular to the first direction, a second linkage slidably connected to the first linkage, the second linkage comprising a body portion extending in the first direction and a neck portion disposed at an end of the body portion of the second linkage, a third linkage rotatably connected to the first linkage at a first end of the third linkage, a telescoping element slidably connected to the third linkage, the telescoping element comprising an abutment portion at an end of the telescoping element, and a housing attachment mechanism coupled to a first surface of the neck portion of the second linkage. The body portion includes a front face that faces the second direction, and a rear face opposite to the front face in the second direction, and the neck portion is inclined at an angle with respect to the front face of the body portion, where the angle is measured about a third axis that is substantially perpendicular to the first direction. The third linkage extends outwardly from the front face of the first linkage.

Embodiments of the disclosure further provide a mountable device assembly. The mountable device assembly includes a device mount, a housing disposed on the device mount via the housing attachment mechanism, and a device enclosed in the housing. The device mount includes a first linkage having a front face that extends in a first direction and faces in a second direction that is perpendicular to the first direction, a second linkage slidably connected to the first linkage, the second linkage comprising a body portion extending in the first direction and a neck portion disposed at an end of the body portion of the second linkage, a third linkage rotatably connected to the first linkage at a first end of the third linkage, a telescoping element slidably connected to the third linkage, the telescoping element comprising an abutment portion at an end of the telescoping element, and a housing attachment mechanism coupled to a first surface of the neck portion of the second linkage. The body portion includes a front face that faces the second direction, and a rear face opposite to the front face in the second direction, and the neck portion is inclined at an angle with respect to the front face of the body portion, where the angle is measured about a third axis that is substantially perpendicular to the first direction. The third linkage extends outwardly from the front face of the first linkage. The mountable device assembly is configured to be temporarily attached to a display having a front face and a back face by adjusting an overall length of the first linkage and the body portion of the second linkage, adjusting an angle between the first linkage and the third linkage, adjusting an overall length of the third linkage and the telescoping element, adjusting a tilt angle and a rotational angle of the housing, placing the abutment portion in contact with the front face of the display, and placing a bottom face of the first linkage opposite to the first linkage in the first direction in contact with the back face of the display. The housing is disposed at a distance from a plane including the front face of the display in a direction towards the back face from the front face of the display.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to a mountable device assembly, and more particularly, to a mountable lighting device.

The embodiments described below provide systems and methods for placing devices, such as portable lights and other peripherals, on a mounting surface, such as a monitor display. In some embodiments, the mounting surface includes a portion of a laptop or tablet that includes a built-in display, a cathode-ray tube (CRT) monitor, a light emitting diode (LED) monitor, a liquid crystal display (LCD) monitor, an organic light-emitting diode (OLED) monitor, a plasma display monitor. The mountable device assembly according to the embodiments described below can be location adjustable and can place a portion of the mountable device assembly at a desired height from the mounting surface, a desired distance behind a back of the mounting surface, and at a desired angle relative to the mounting surface. In addition, the mountable device assemblies described herein can also be held in the hand and allows the device to be used as a hand-held device.

Figure 1A:
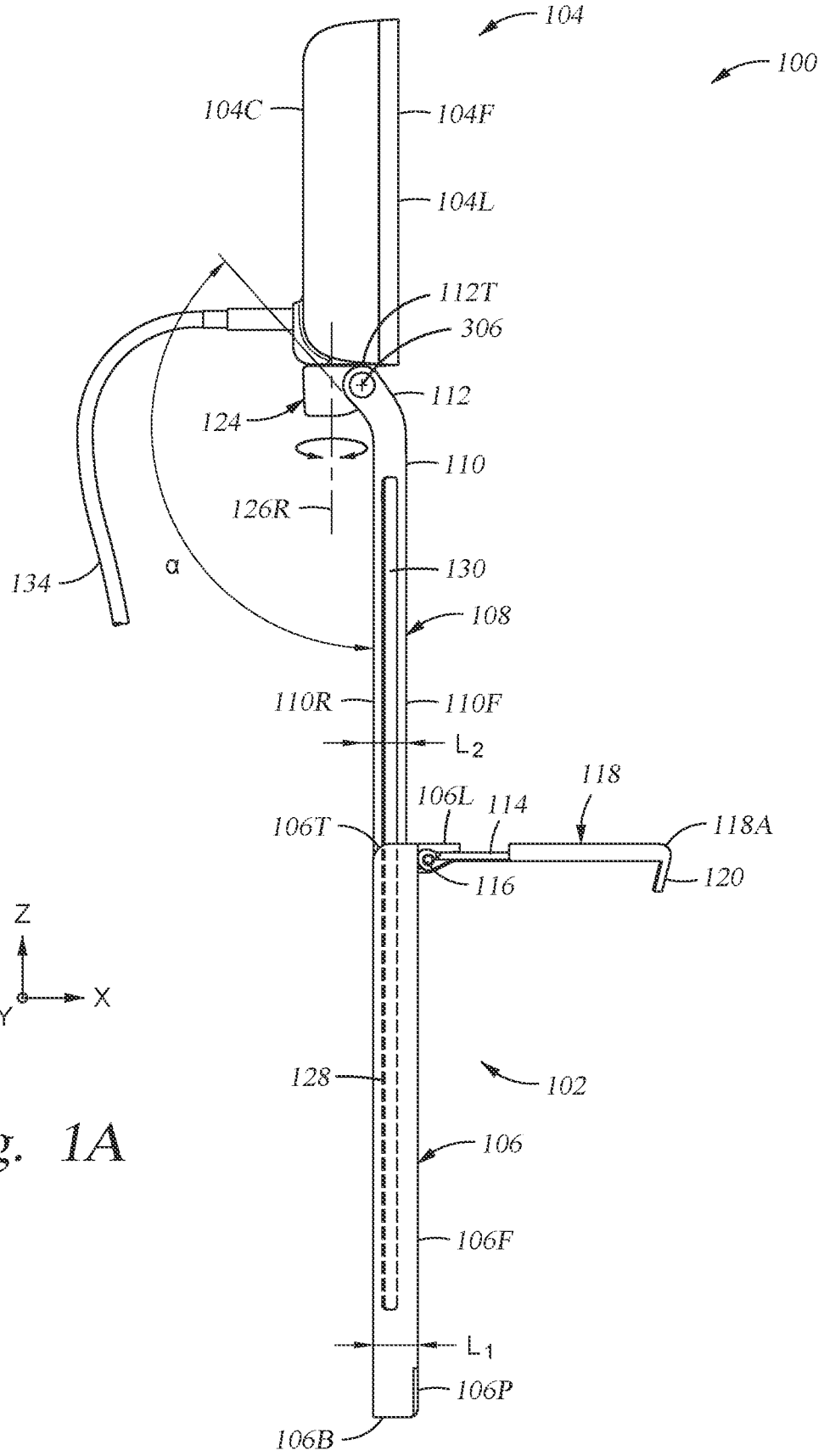
FIGS. 1A, 1B, 1C are a side view, a rear view, and a front view, respectively, of a mountable device assembly according to one embodiment, in an extended configuration.
Figure 1B:
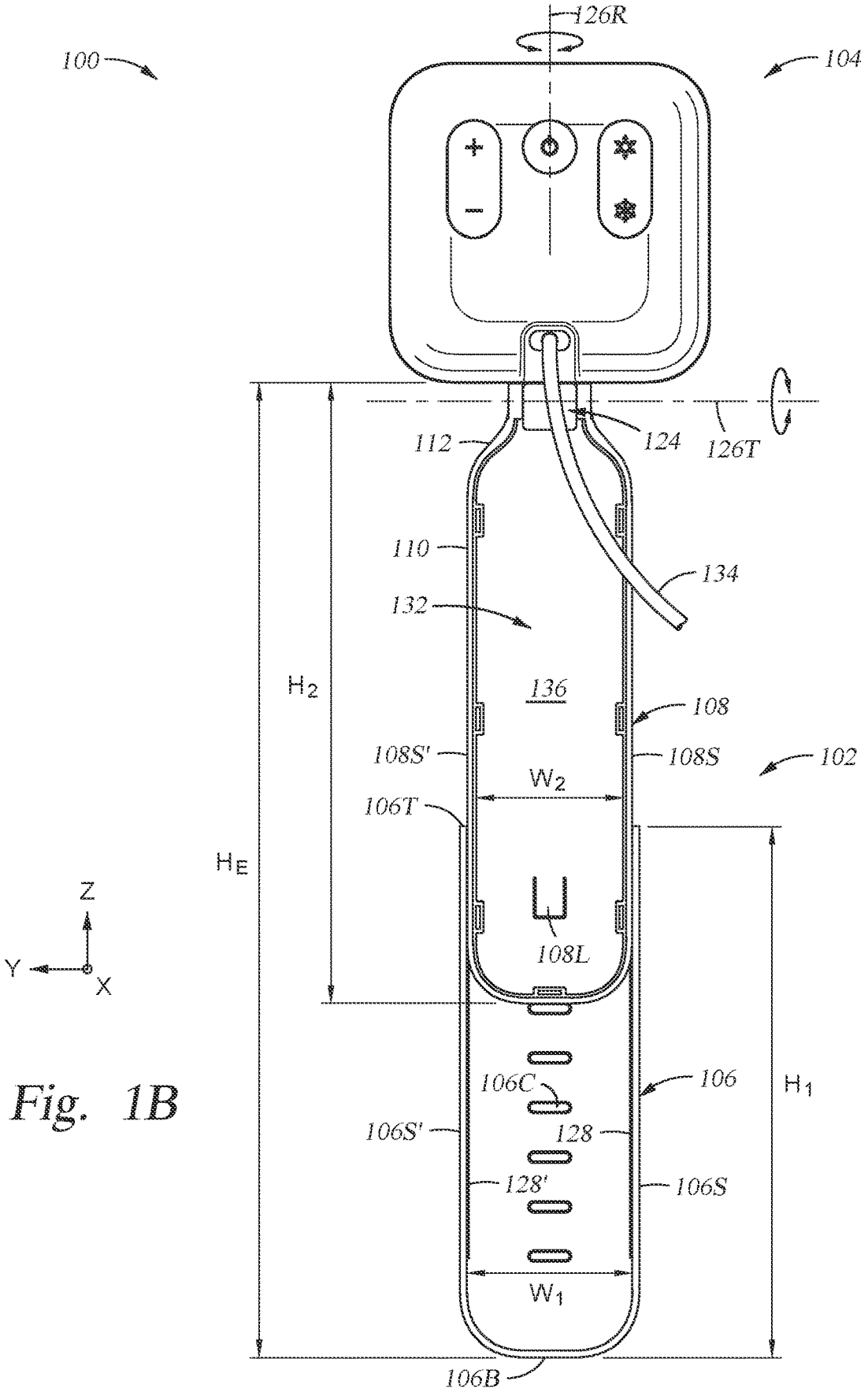
Figure 1C:
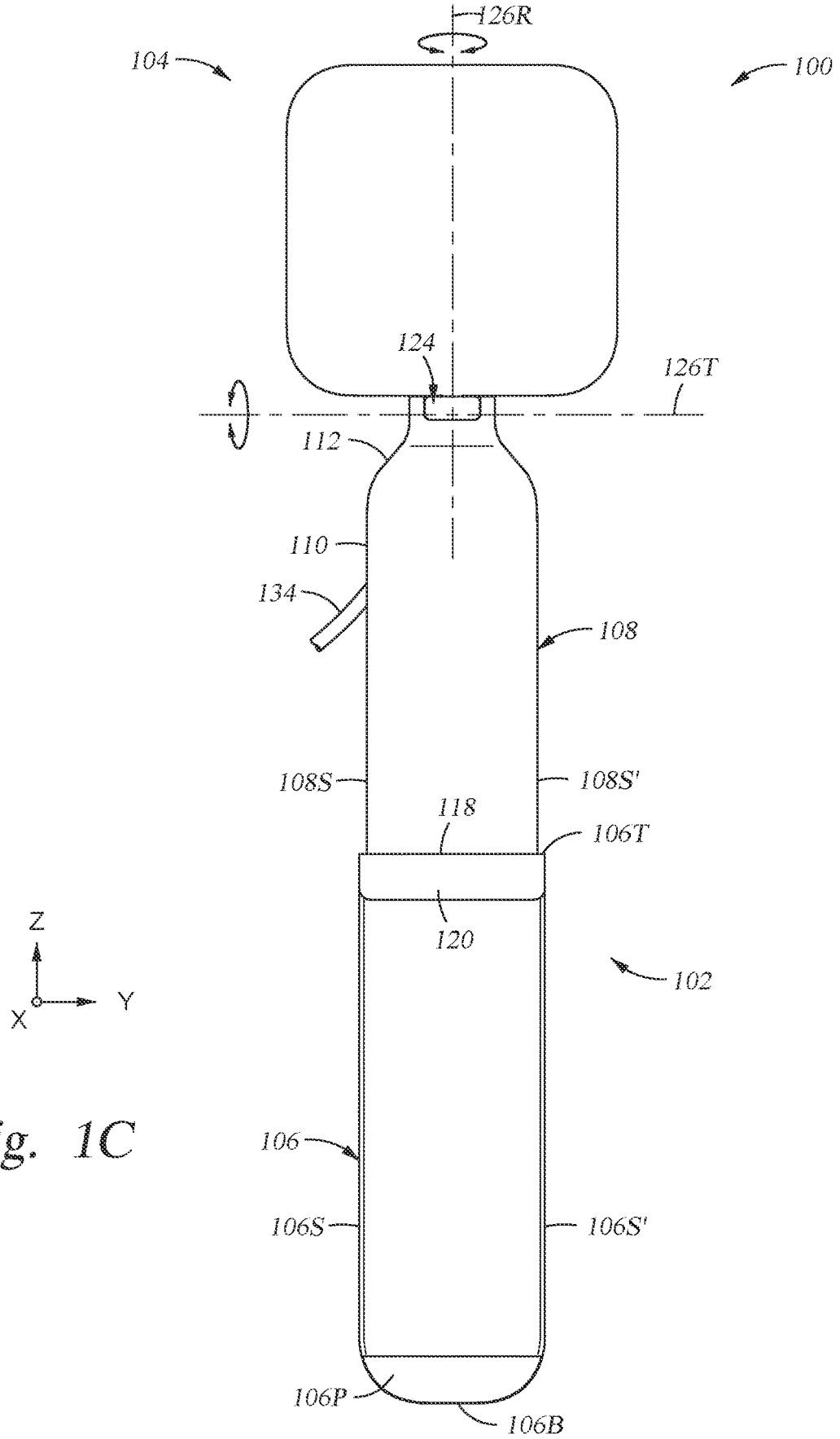
Figure 1D:
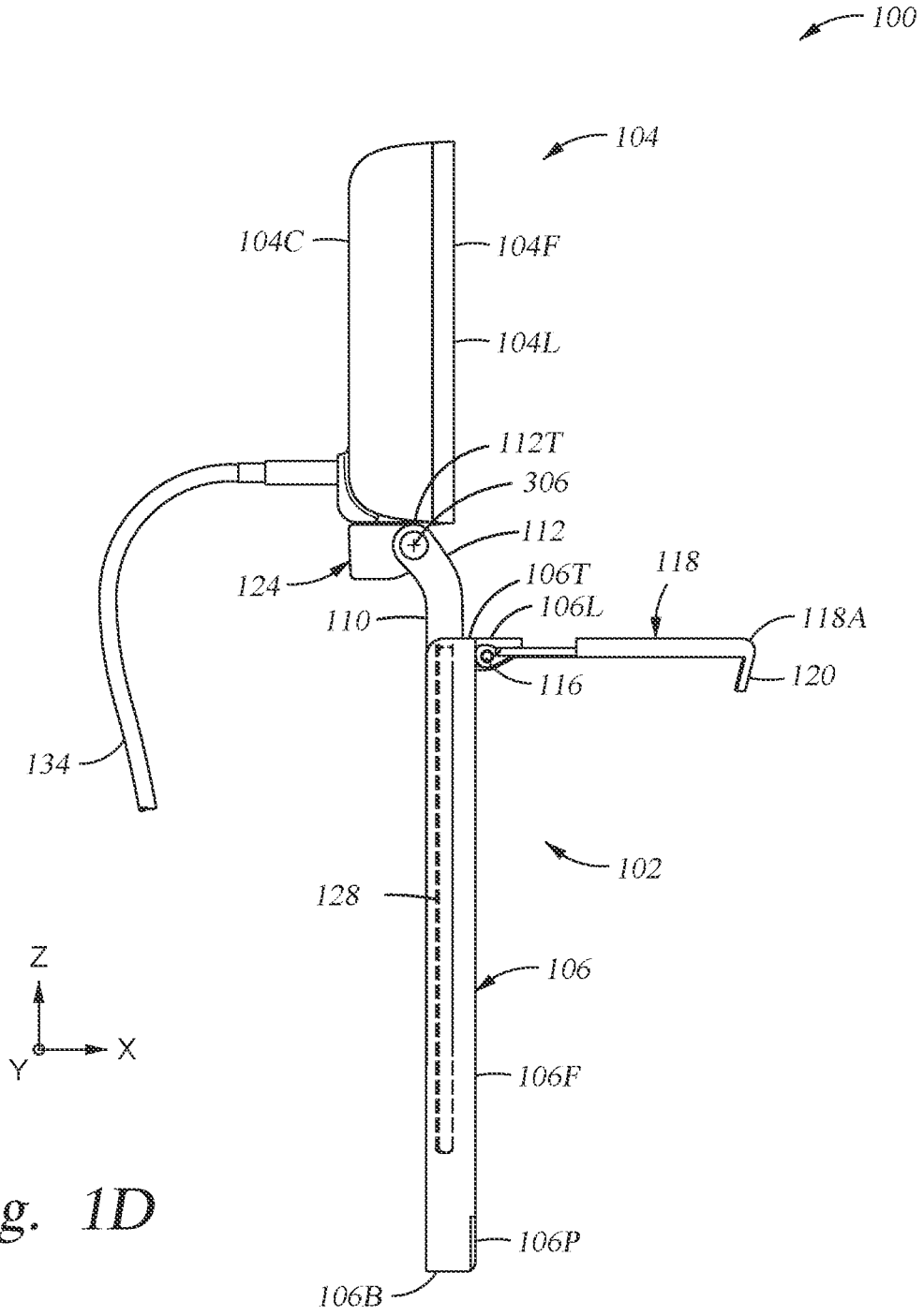
FIGS. 1D, 1E, and 1F are a side view, a rear view, and a front view, respectively, of a mountable device assembly according to one embodiment, in a fully retracted configuration.
Figure 1E:
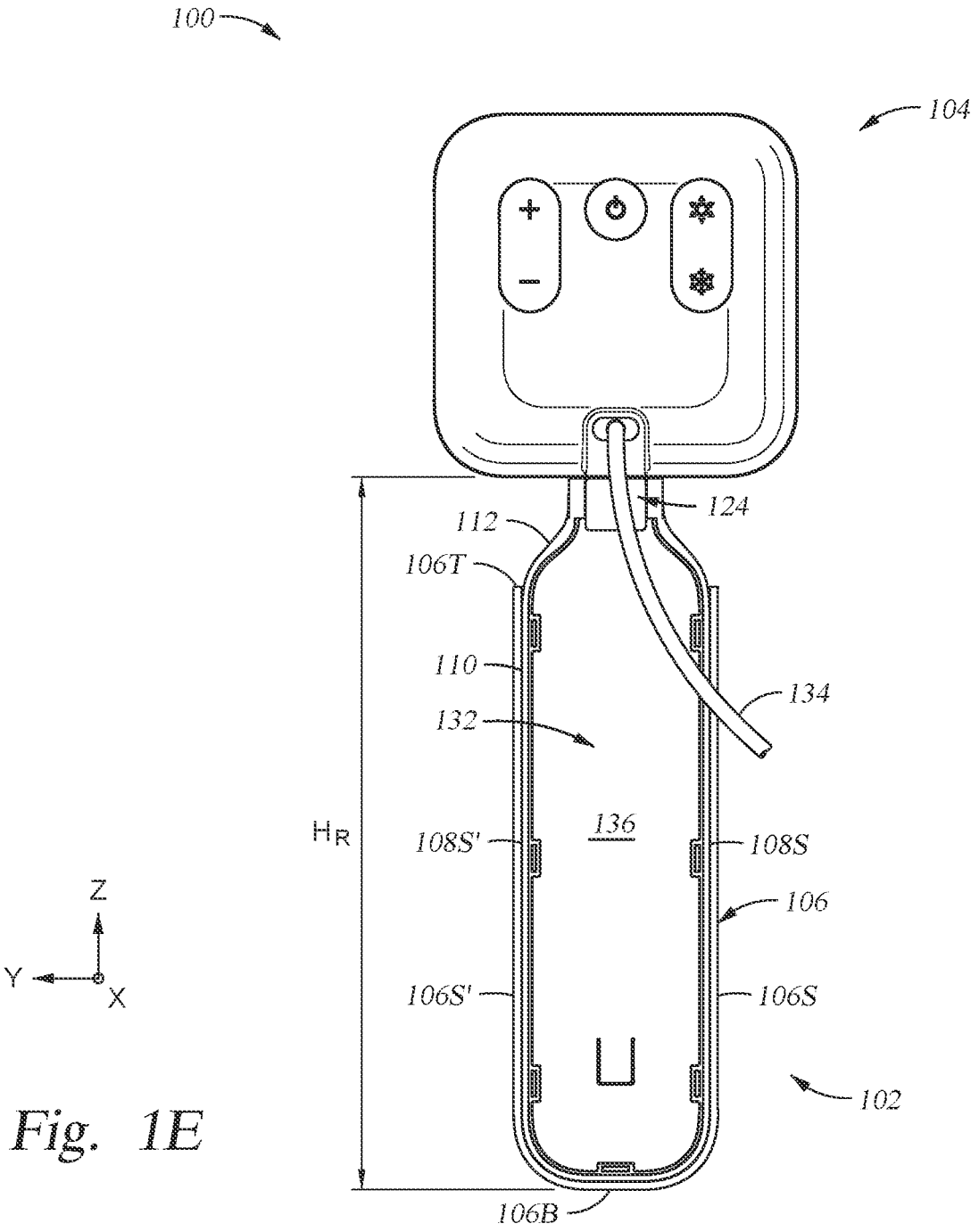
Figure 1F:
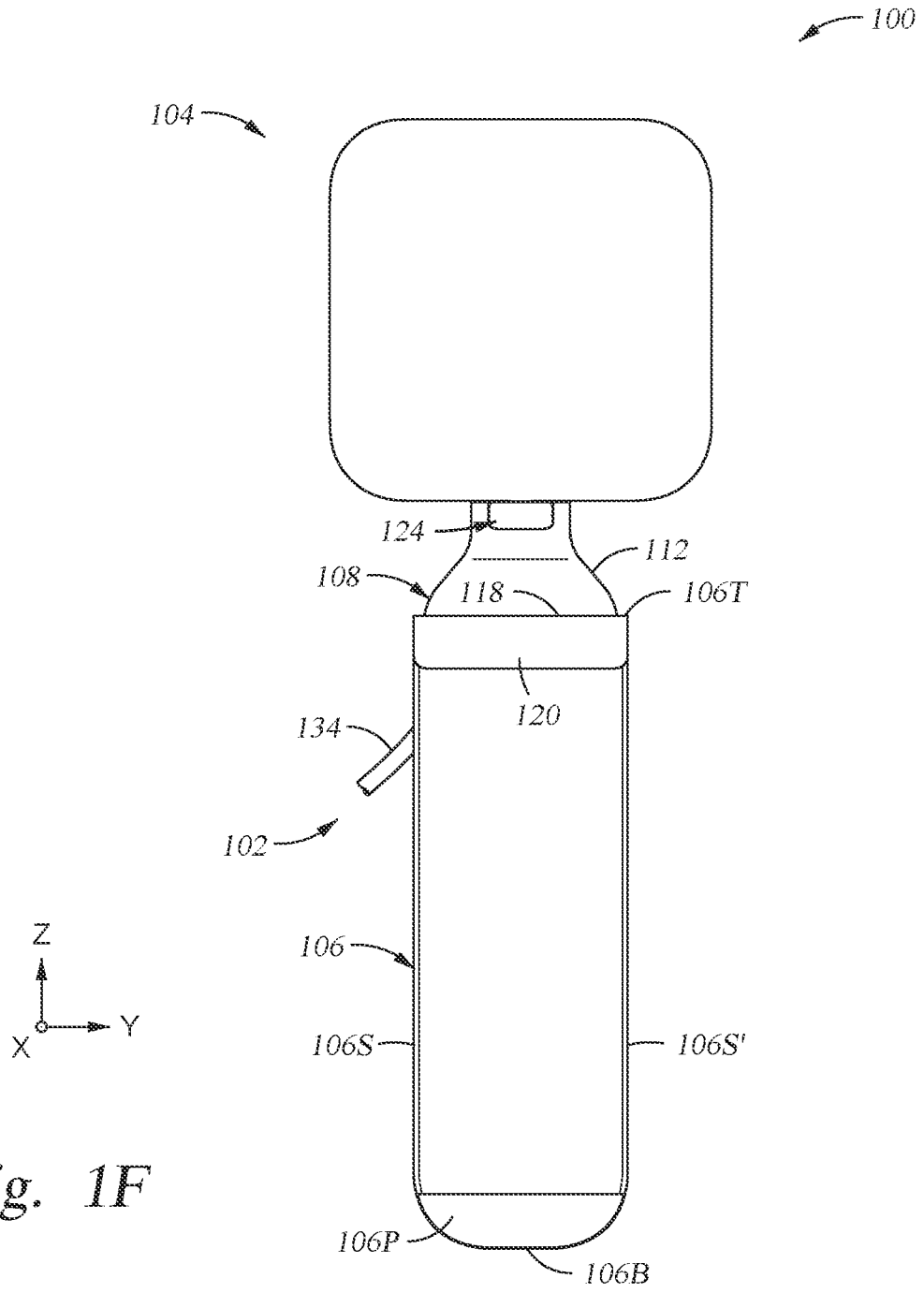
Figure 6A:
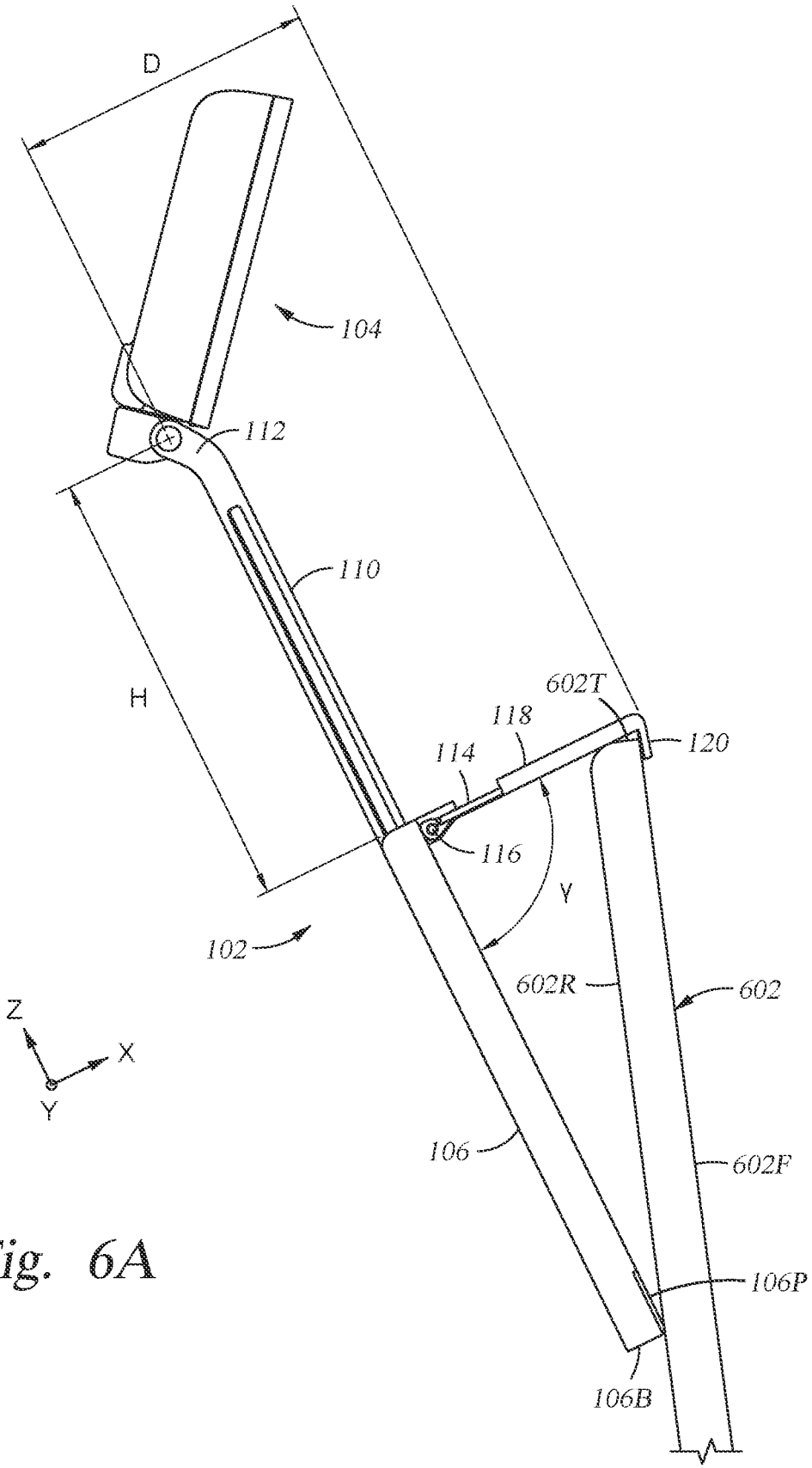
FIGS. 6A and 6B illustrate an exemplary use of a mountable device assembly, according to one embodiment.
Figure 6B:
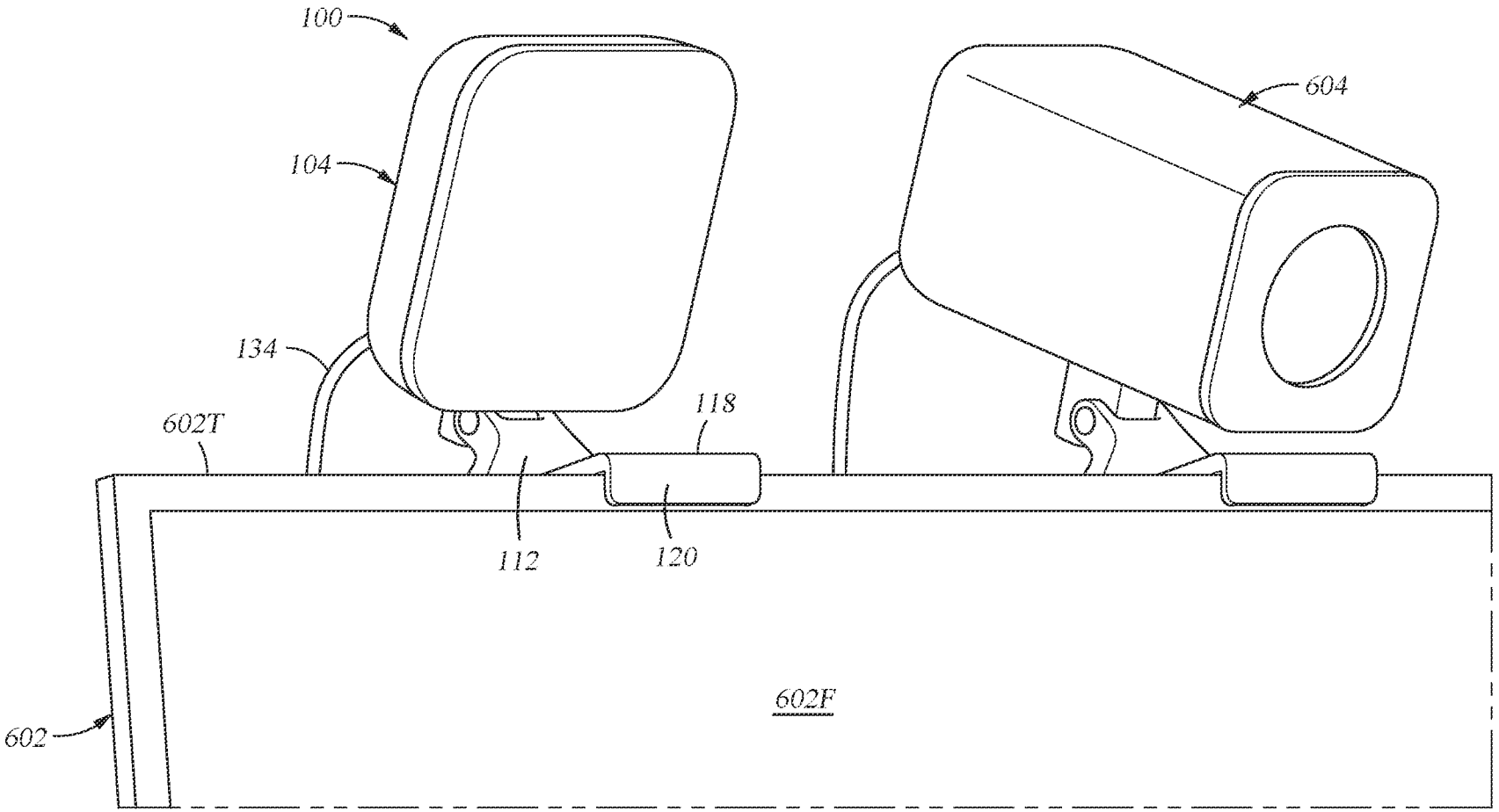

FIGS. 1A, 13, and 1C are a side view, a rear view, and a front view, respectively, of one configuration of a mountable device assembly, which is referred to herein as a portable light 100. The portable light 100, as illustrated in FIGS. 1A, 1B, and 1C, is positioned in an extended configuration. FIGS. 1D, 1E, and 1F are a side view, a rear view, and a front view, respectively, of the portable light 100, in a fully retracted configuration. The portable light 100 includes a mount 102 and a housing 104 disposed on and/or coupled to the mount 102. The mount 102 includes a first linkage 106 having a front face 106F (FIG. 1A) and side faces 106S, 106S' (FIG. 1B) each connected to the front face 106F, and a second linkage 108 having a body portion 110 and a neck portion 112. The body portion 110 of the second linkage 108 is slidably connected to the first linkage 106 and can slide in and out of the first linkage 106 through a top edge 106T of the first linkage 106 in the Z direction. As described herein, the mount 102 may be considered to be in a "fully extended" configuration, for example, when the body portion 110 of the second linkage 108 is substantially extended from the top edge 106T of the first linkage 106, and in a "fully retracted" configuration, for example, when the body portion 110 of the second linkage 108 is substantially retracted within a space formed within the first linkage 106. The first linkage 106 may have a bottom wall 106B, and thus the first linkage 106 acts as a case in which the body portion 110 of the second linkage 108 fits when it is positioned in the fully retracted configuration. In some embodiments, the first linkage 106 has a friction pad 106P on the front face 106F near or adjacent to the bottom wall 106B. The friction pad 106P is formed from a compliant material that is configured to prevent the first linkage 106 from sliding against a surface on which the portable light 100 mounted, for example, a monitor display as shown in FIGS. 6A and 6B below. In one example, the friction pad 106P is formed from a low durometer polymer and/or high friction material, such as a rubber or other polymeric material. Also as described herein, a direction referred to as "front" or "forward" may be understood as towards a front face 110F of the body portion 110 of the second linkage 108 from a rear face 110R of the body portion 110 of the second linkage 108 in the X direction, and a direction referred to as "rear," "rearward," "back," or "behind" may be understood as towards the rear face 110R of the body portion 110 of the second linkage 108 from the front face 110F of the body portion 110 of the second linkage 108 in the X direction, A direction referred to as "top," "upwards," and "above" may be understood as towards the top edge 106T of the first linkage 106 from the bottom wall 106B of the first linkage 106, and a direction referred to as "bottom," "downwards," and "below" may be understood as towards the bottom wall 106B of the first linkage 106 from the top edge 106T of the first linkage 106.

The first linkage 106 may have a length $H_1$ (FIG. 1B) in the Z direction of between about 100 mm and about 700 mm, such as between about 100 mm and about 350 mm, or between about 100 mm and about 260 mm, for example, about 151 mm. The first linkage 106 may have a thickness (FIG. 1A) of between about 5 mm and about 60 mm, such as between about 5 mm and about 30 mm, for example, about 12 mm. The first linkage 106 may also have an inner width $W_1$ (FIG. 1B) in the Y direction of between about 20 mm and about 250 mm, such as between about 20 mm and about 50 mm, for example, about 47 mm. The body portion 110 of the second linkage 108 may have a length $H_2$ (FIG. 1B) in the Z direction of between about 100 mm and about 720 mm, such as between about 120 mm and about 370 mm, for example, about 174 mm. The body portion 110 of the second linkage 108 may have a thickness $L_2$ (FIG. 1A) in the X direction of between about 5 mm and about 60 mm, such as between about 5 mm and about 30 mm, for example, about 8.5 mm. The body portion 110 of the second linkage 108 may have a width $W_2$ (FIG. 1B) in the Y direction of between about 20 mm and about 250 mm, such as between about 15 mm and about 50 mm, for example, about 43 mm. Thus, an overall length $H_E$ (FIG. 1B) of the first linkage 106 and the body portion 110 of the second linkage 108 combined in a fully extended configuration is between about 176 mm and about 576 mm, for example, about 233 mm, and an overall length $H_R$ (FIG. 1E) of between about 118 mm and about 368 mm, for example, about 177 mm, in a fully retracted configuration.

The mount 102 further includes a third linkage 114 (FIG. 1A) that is rotatably attached to the first linkage 106 via a hinge 116 at the top edge 106T of the first linkage 106. The third linkage 114 can rotate about an linkage axis that is parallel to the Y-axis, between an open configuration (FIGS. 1A and 2B), in which the third linkage 114 extends outwardly from the front face 106F of the first linkage 106 substantially perpendicular to the front face 106F of the first linkage 106 in the +X direction, and a closed configuration (FIG. 2E), in which the third linkage 114 extends downwardly towards the bottom wall 106B of the first linkage 106 in the −Z direction. The third linkage 114 in the open configuration is illustrated in FIGS. 1A and 1D, as an example. In some embodiments, the hinge 116 is configured such that rotational motion between a portion of the third linkage 114 and a portion of the first linkage 106 is inhibited by friction (or by use of an additional torsional spring (not shown)) created between these linkage portions due to an interference fit between these parts. By adjusting the friction created between the portion of the third linkage 114 and the portion of the first linkage 106 to a desired amount during the design and manufacturing process, the position of the third linkage 114 relative to the first linkage 106 can be set and maintained at a desired angle between the third linkage 114 and the first linkage 106 during use. In some embodiments, the angle between the third linkage 114 and the first linkage 106 is fixed at about 0° (in the closed configuration) or about 90° (in the open configuration).

The mount 102 further includes a telescoping element 118 that is slidably connected to the third linkage 114, as shown in FIGS. 1A, 2A, 2B, and 2E. The telescoping element 118 includes an abutment portion, such as a lip portion 120, disposed at an end 118*a* of the telescoping element 118 opposite to the top edge 106T of the first linkage 106 in the X direction. The lip portion 120 extends substantially in a direction perpendicular to the third linkage 114 from the top edge 106T of the first linkage 106 towards the bottom wall 106B of the first linkage 106. In some embodiments, the lip portion 120 is fixed at an angle of less than 90° from the telescoping element 118. In some other embodiments, the lip portion 120 is connected to the telescoping element 118 via a friction hinge (not shown), which may include one or more detents (not shown), that allow positioning of the lip portion 120 at a variable angle with respect to the telescoping element 118 variable.

The neck portion 112 of the second linkage 108 is positioned at an end of the body portion 110 of the second linkage 108 opposite to the first linkage 106 in the Z direction. The neck portion 112 is inclined at an angle in the Z-X plane with respect to the body portion 110 of the second linkage 108 in the direction extending away from the front face 110F of the body portion 110 of the second linkage 108 and towards the rear face 110R of the body portion 110 of the second linkage 108, and also away from the third linkage 114. Thus, the neck portion 112 is disposed at the rear of the third linkage 114 (i.e., at a location further away from the front face 106F of the first linkage in a direction (−X-direction) opposite to the direction the front face 106F is facing). In some embodiments, an angle c formed between the neck portion 112 and the body portion 110 of the second linkage 108 is between about 0° and about 180°.

The housing 104 is movably attached to the neck portion 112 of the second linkage 108 via a housing attachment mechanism 124 disposed on a top surface 112T of the neck portion 122 of the second linkage 108. The top surface 112T of the neck portion 122 of the second linkage 108 is continuous with the front face 110F of the body portion 110 of the second linkage 108. The housing attachment mechanism 124 allows the housing 104 to tilt about a tilt axis 126T (FIG. 1B) in the Z-X plane and rotate about a rotation axis 126R (FIG. 1A) that is perpendicular to the top surface 112T of the neck portion 112 of the second linkage 108. The housing attachment mechanism 124 is discussed in more details below in reference to FIGS. 3A, 3B, and 3C.

The housing 104 may enclose therein a variety of related devices and peripherals known to those of skill in the art. For example, the housing 104 may include a portable light (not shown), electronic elements (not shown), a digital camera (not shown), a digital camera (not shown), and/or various hardware modules and the like that may be placed on a computer monitor. An example device that may be enclosed in the housing 104 is discussed in more details below in references to FIG. 4. In some embodiments, as shown in FIGS. 1C and 1F, the housing 104 includes an outer casing 104C and a lens 104L. In one configuration, a device 400 (FIG. 4), which is discussed further below, is positioned in an enclosed region (not shown) formed between the outer casing 104C and the lens 104L. In one example, the device 400 includes one or more light sources (e.g., array of light sources 402) that are configured to emit a plurality of wavelengths of light (e.g., white light) that pass through the lens 104L in a direction that is normal to the front surface 104F (FIG. 1D) of the lens 104L, which, as shown in FIG. 1D, is generally parallel to the X-Z plane. In some embodiments, the lens 104L, due to features formed on one or more surfaces thereof, is configured to act as a diffuser that diffuses or scatters light to reduce the collimation of the emitted light and make the light transmitted from the housing 104 to appear "softer." The act of diffusing the emitted light by the lens 104L will reduce the chance of a noticeable reflection being generated off of one or more exposed surfaces (e.g., glasses of a user) within the environment surrounding the mount 102.

Figure 5:
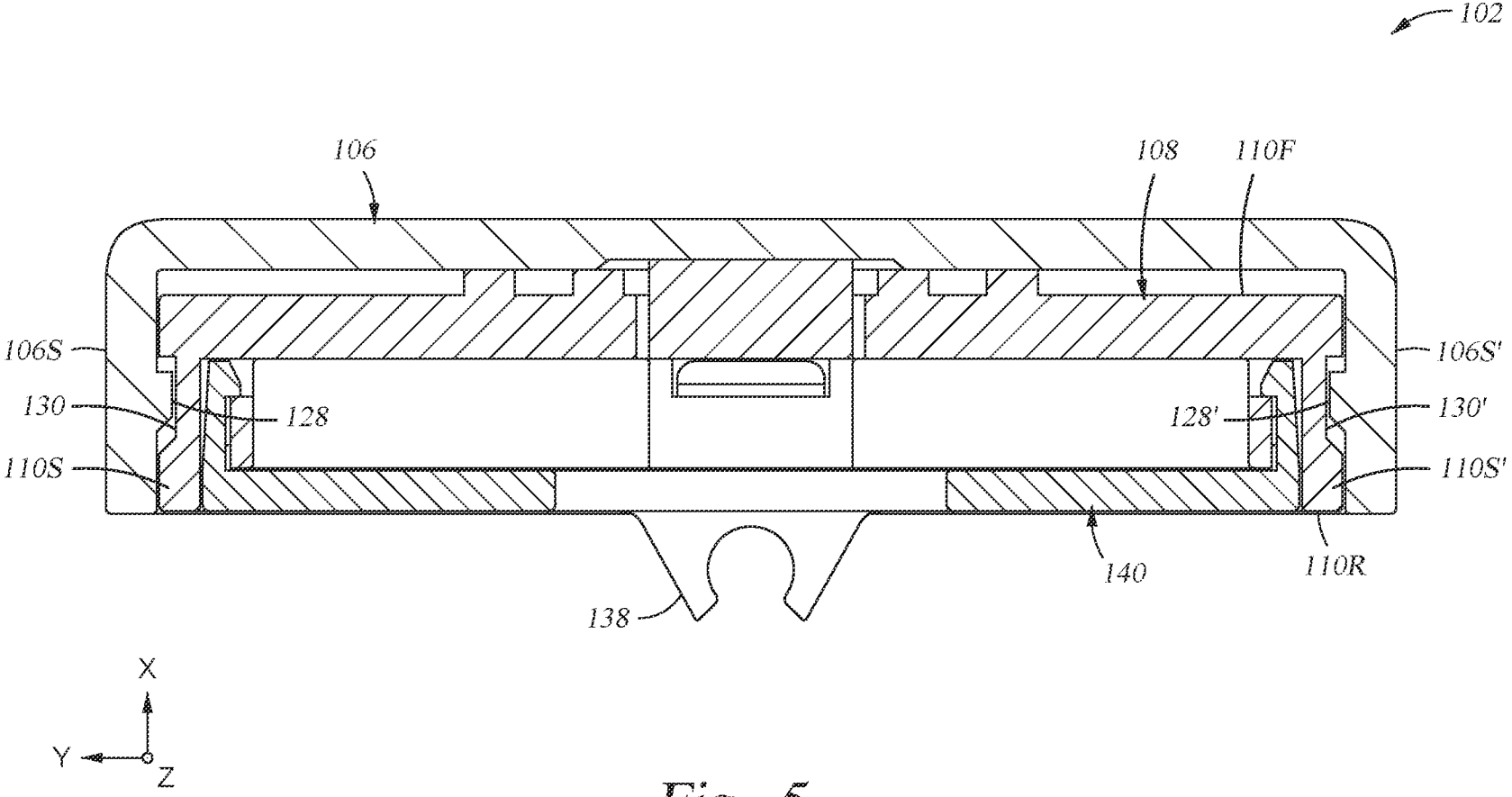
FIG. 5 is a cross sectional view of a first linkage and a body portion of a second linkage, according to one embodiment.

Referring to FIGS. 1A, 1B, and 5, the mount 102 further includes an engagement mechanism that allows the body portion 110 of the second linkage 108 to slide in and out of the first linkage 106 in the Z direction when an external force (e.g., pushing or pulling) is applied in the Z-direction to the first linkage 106, the second linkage 108, or both. In some embodiments, the engagement mechanism of the mount 102 includes fins (also referred as "protrusion") 128, 128' (FIGS. 1B and 5) formed on inner surfaces of the side faces 106S, 106S' of the first linkage 106 and grooves 130, 130' (FIGS. 1A and 5), formed in outer surfaces of side faces 110S, 110S' of the body portion 110 of the second linkage 108. Due to friction created between components 106C in the first linkage 106 and a ledge 108L on the front face 110F of the body portion 110 of the second linkage 108, the relative position of the second linkage 108 and the first linkage 106 can be maintained at a desired location within the first linkage 106 when no external force is applied.

The mount 102 further includes a cable management system 132 on the rear face 110R of the body portion 110 of the second linkage 108, as illustrated in FIGS. 1B and 1E. The cable management system 132 may be used to store a cable 134 connected to the housing 104. The cable management system 132 is discussed in more details below in reference to FIGS. 1B and 1E.

Figure 2B:
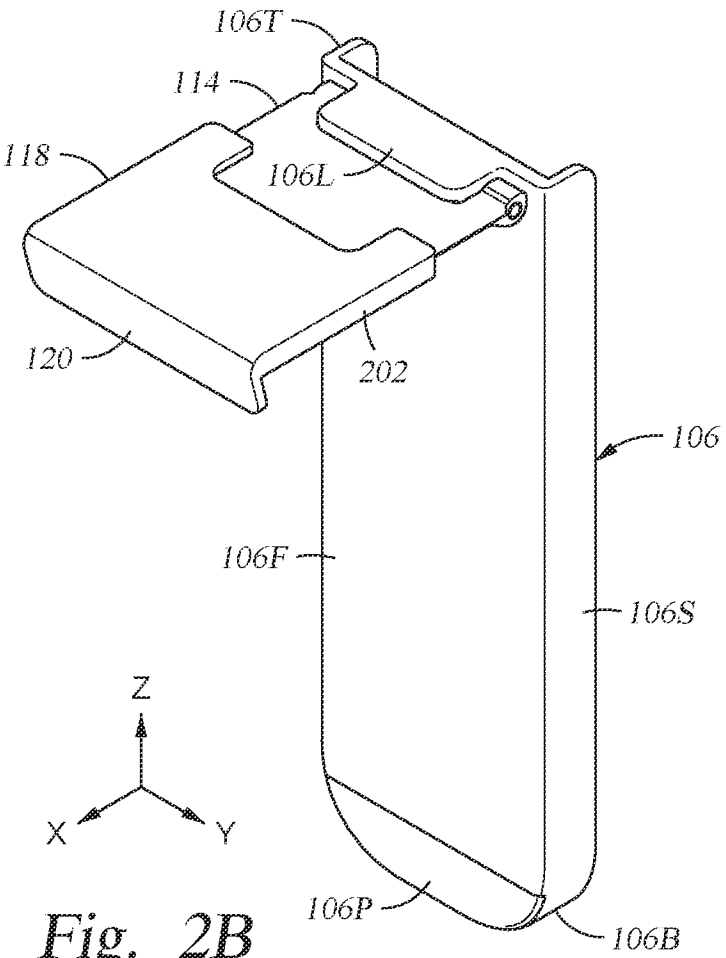
FIGS. 2A 2B, 2C, 2D, and 2E are enlarged isometric views of a portion of a mountable device assembly according to one embodiment.
Figure 2A:
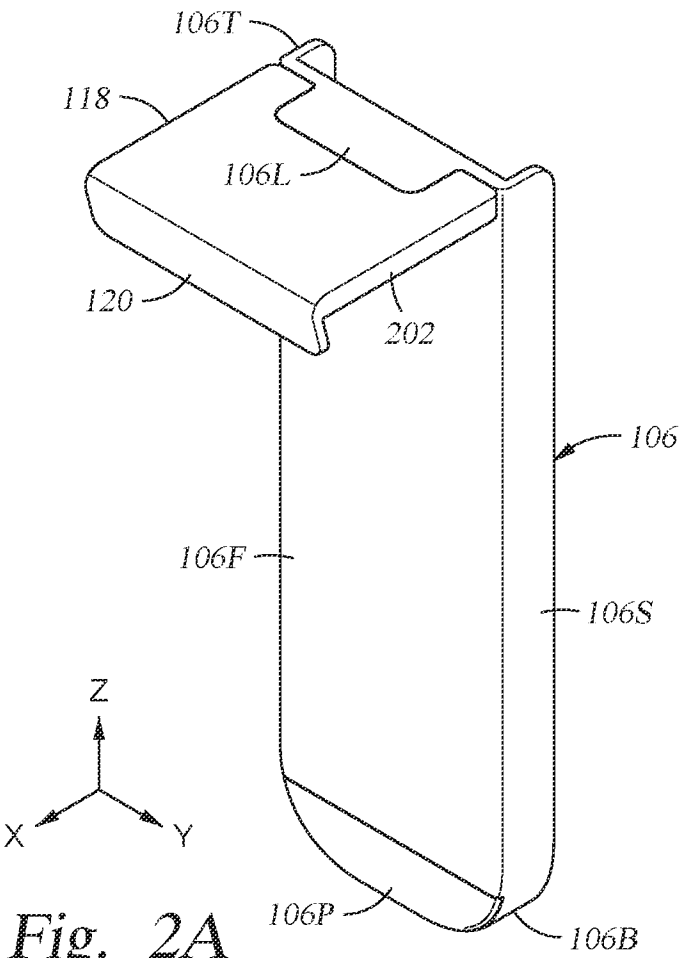
Figure 2C:
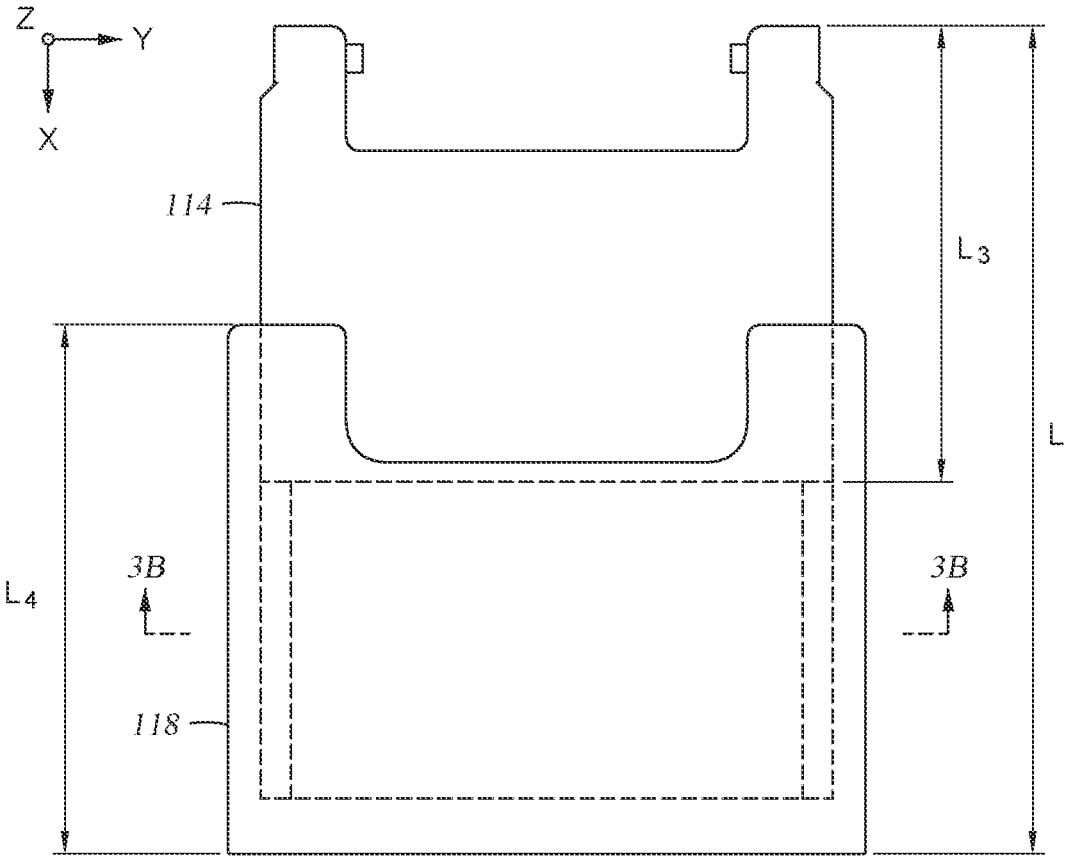
Figure 2D:
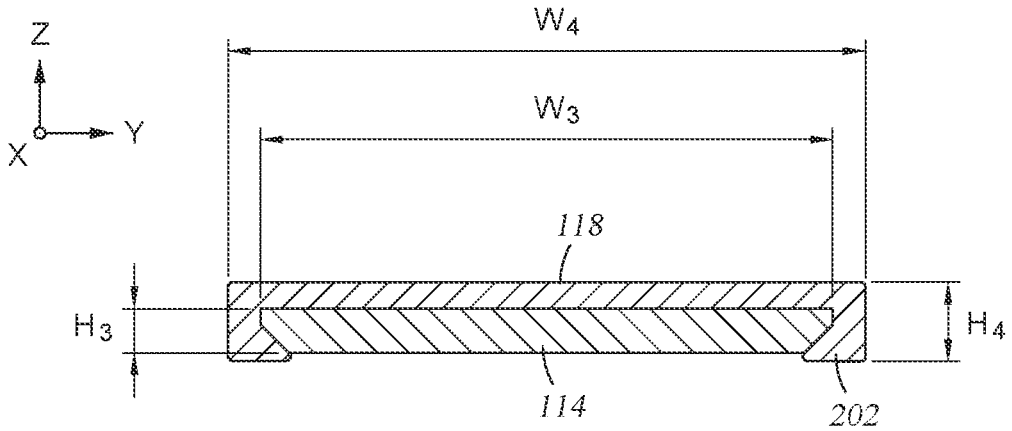
Figure 2E:
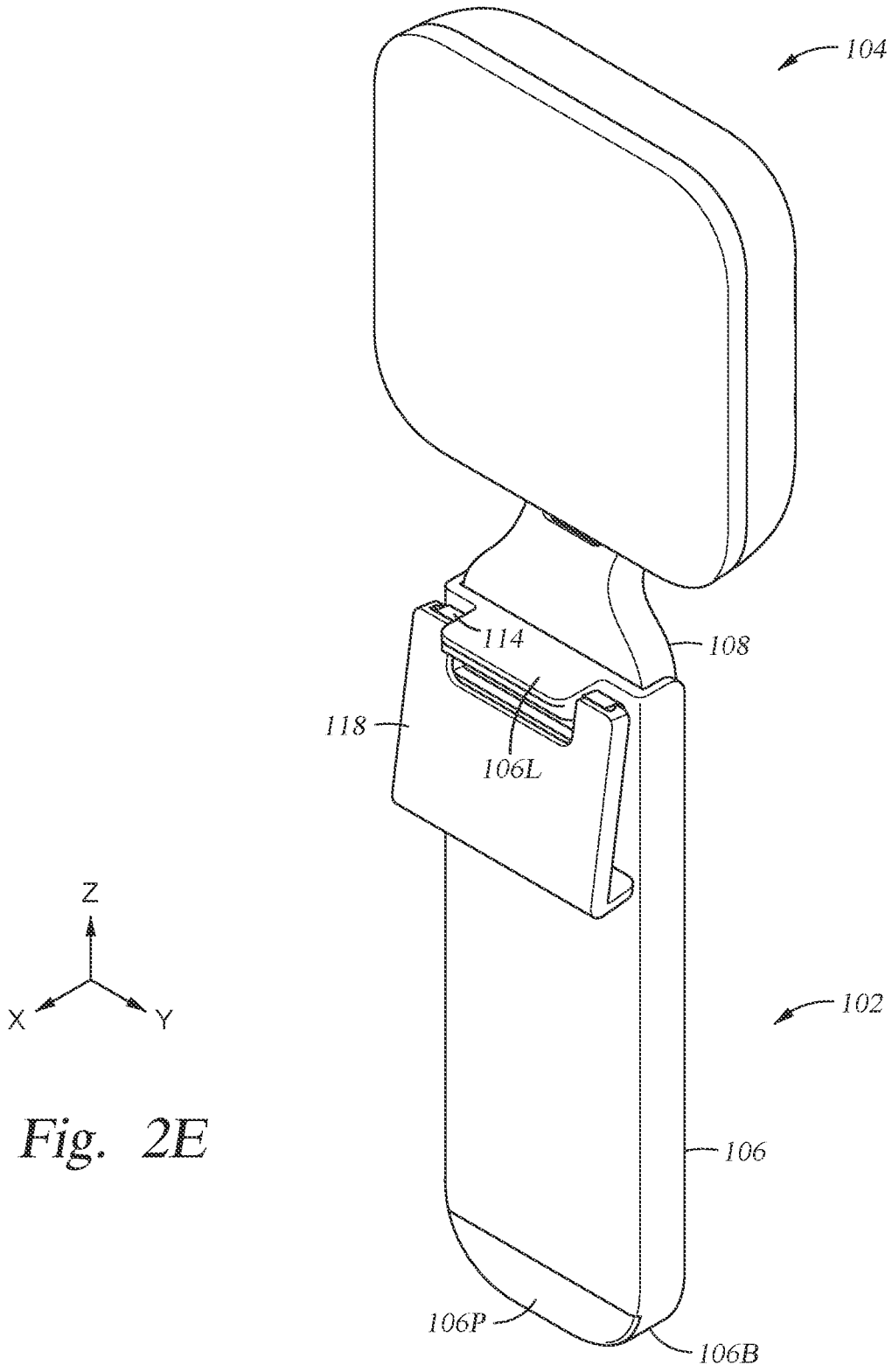

FIGS. 2A and 2B are enlarged isometric views of a portion of the portable light 100 including the first linkage 106 and the third linkage 114 in a compressed configuration and in a released configuration, respectively, while the third linkage 114 is in the open configuration. FIGS. 2C and 2D are a top view and a side view of the third linkage 114 and the telescoping element 118, respectively. FIG. 2E is an enlarged isometric view of a portion of the portable light 100 including the first linkage 106 and the third linkage 114 in a compressed configuration and in a released configuration, respectively, while the third linkage 114 is in the closed configuration. As described herein, the mount 102 may be considered to be in a "fully compressed" configuration, for example, when an end of the telescoping element 118 opposite to the lip portion 120 mates with a ledge portion 106L of the first linkage 106, and in a "fully released" configuration, for example, when a hard stop (not shown) formed in one end of the third linkage 114 is placed in contact with a hard stop (not shown) portion of the telescoping element 118 when the telescoping element 118 is moved to a position that is a distance away from the hinge 116. As illustrated in FIGS. 2A and 28, in one example, the third linkage 114 extends outwardly from the front face 106F of the first linkage 106 substantially perpendicular to the front face 106F of the first linkage 106 in the X direction (i.e., in an open configuration). The telescoping element 118 includes end tabs 202 on both sides of the telescoping element 118. The end tabs 202 are disposed outside of the third linkage 114 and engaged with side faces 114S, 114S' of the third linkage 114, when the telescoping element 118 is slidably connected to the third linkage 114. The end tabs 202 allow the telescoping element 118 to telescope in and out on the third linkage 114 in the X direction. The third linkage 114 may have a length $L_3$ (FIG. 2C) in the X direction of between about 20 mm and about 80 mm, for example, about 40 mm, a width $W_3$ (FIG. 2D) in the Y direction of between about 20 mm and about 450 mm, for example, about 45 mm, and a thickness $H_3$ (FIG. 2D) in the Z direction of between about 2 mm and about 50 mm, for example, about 2 mm. The telescoping element 118 has a width $W_4$ (FIG. 2D) in the Y direction that is longer than the width $W_3$ (FIG. 2D) of the third linkage 114, such that the third linkage 114 fits in the telescoping element 118. The end tabs 202 each have a length $H_4$ (FIG. 2D) in the Z direction between about 3 mm and about 50 mm, for example, about 4.5 mm. Thus, an overall length L (FIG. 2C) of the third linkage 114 and the telescoping element 118 in the X direction can vary between about 42 mm and about 66 mm.

Figure 3A:
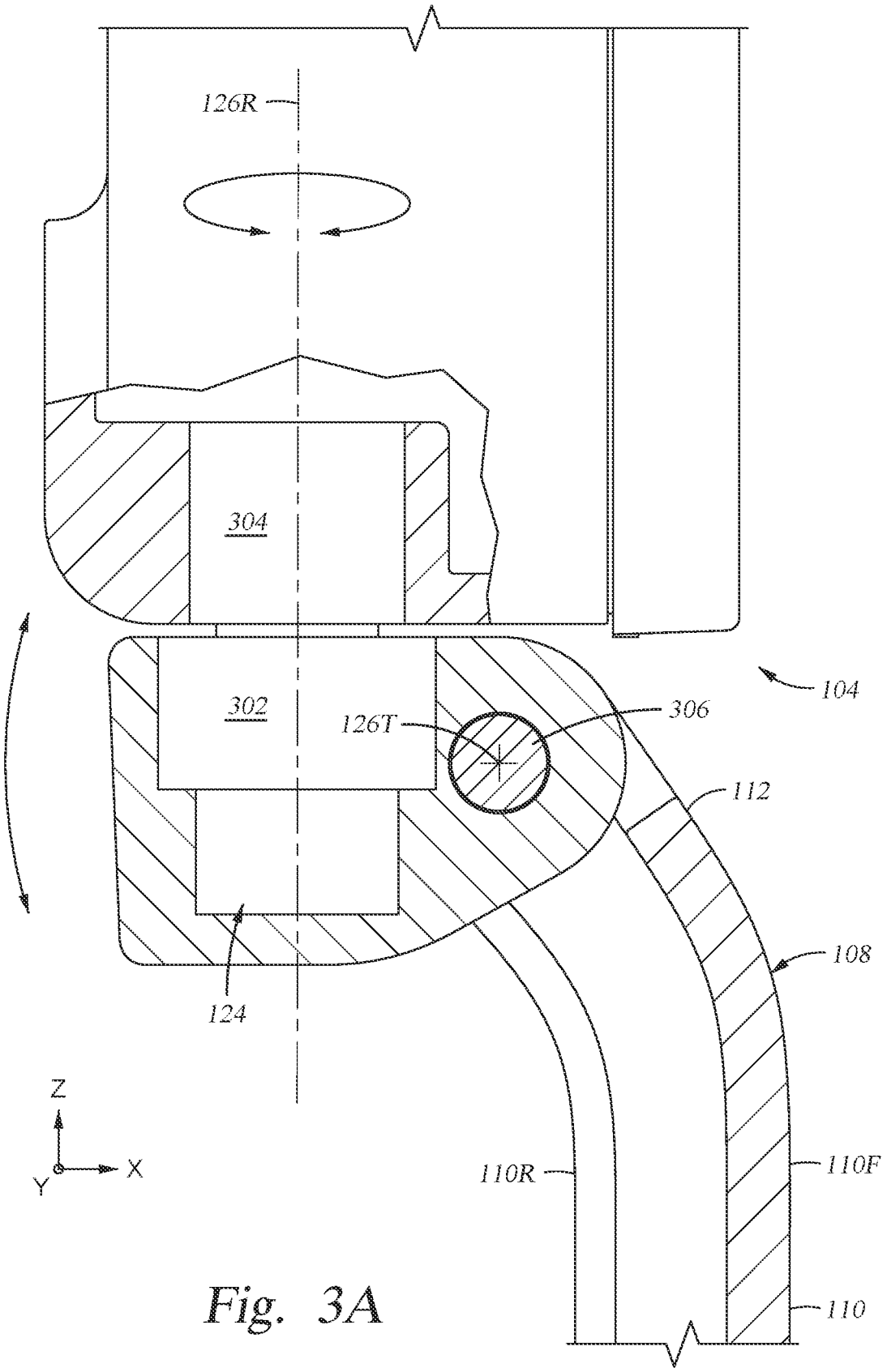
FIGS. 3A and 3B are enlarged side views of a portion of a mountable device assembly according to one embodiment.
Figure 3B:
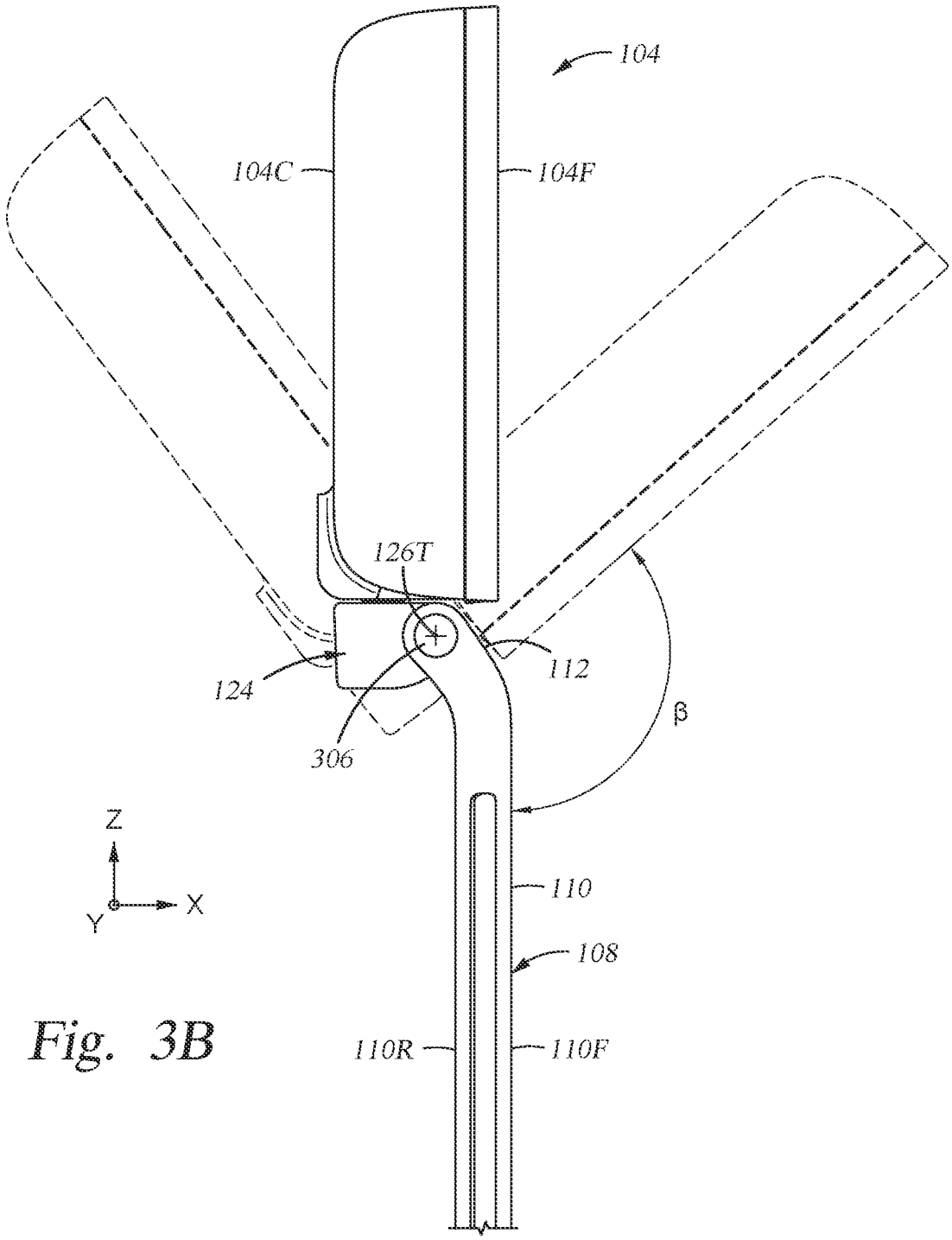
Figure 3C:
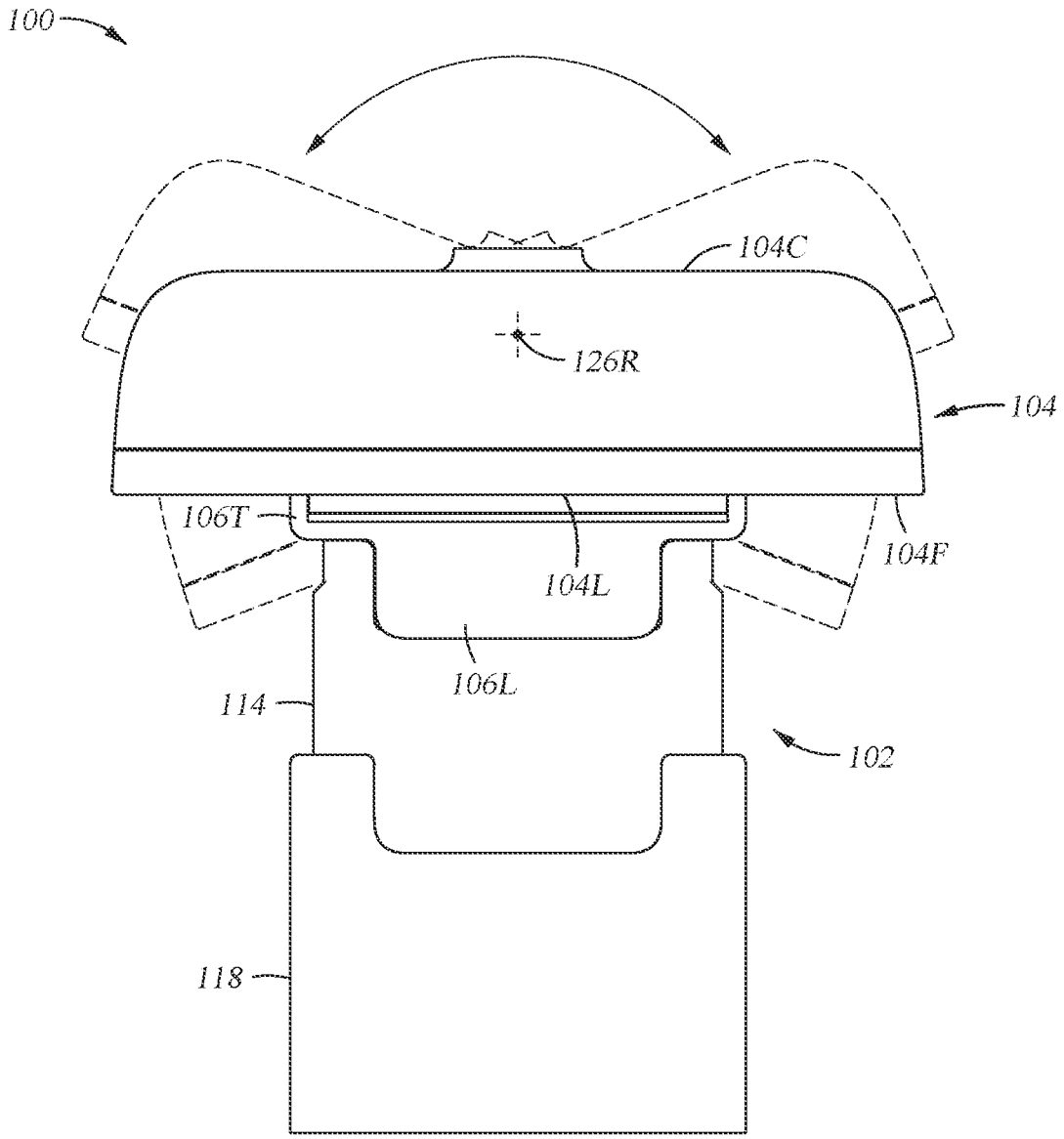
FIG. 3C is a top view of a mountable device assembly according to one embodiment.
Figure 3C:
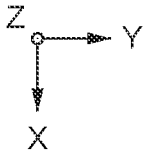

FIGS. 3A and 3B are enlarged side views of a portion of the portable light 100 including the housing attachment mechanism 124. FIG. 3C is a top view of the portable light 100. The housing attachment mechanism 124 may take various forms, such as a hinge or a ball joint, and allows the housing 104 to tilt about the tilt axis 126T in the Z-X plane and rotate about the rotation axis 126R. In the example illustrated in FIG. 3, the housing attachment mechanism 124 includes a ball socket pin 302 disposed on the neck portion 122 of the second linkage 108, and a recessed socket joint 304 formed in the housing 104. Thus; the housing 104 can rotate about the ball socket pin 302. In some other embodiments, this arrangement can be reversed, or otherwise modified. For example, a ball socket pin 302 may be disposed on the housing 104 and a recessed socket joint 304 may be disposed on the neck portion 122 of the second linkage 108. In some embodiments, the housing 104 can rotate up to 360° about the rotation axis 126R. The housing attachment mechanism 124 further includes an axial friction hinge 306 that allows the housing 104 to tilt about the tilt axis 126T in the Z-X plane. An angle β of the housing 104 with respect to the Z axis can be varied between about 90° and about 360°, such as between about 90° and about 210°.

Figure 4:
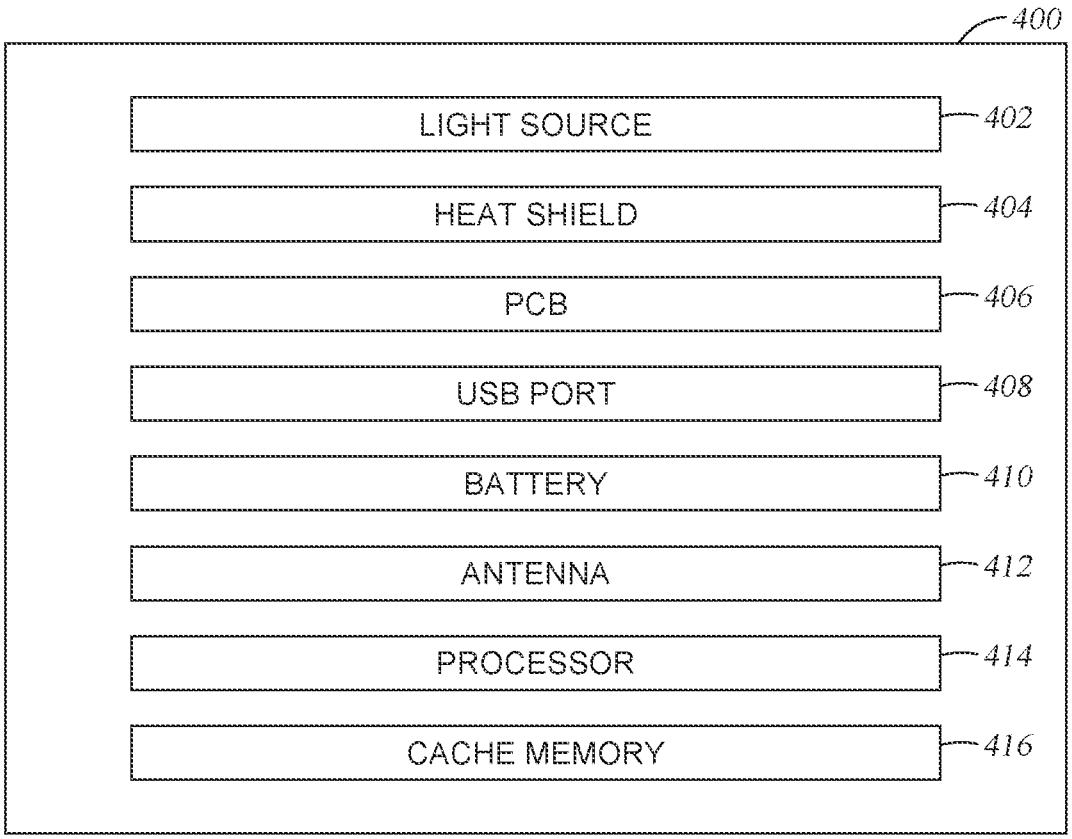
FIG. 4 is a simplified block diagram of a mountable device assembly according to one embodiment.

FIG. 4 is a simplified block diagram of a device 400, which may be included in the portable light 100, for example, enclosed within the housing 104. The device 400 may include various standard modules, such as an array of light sources 402 (e.g., light emitting diodes), a heat shield 404, a printed circuit board (PCB) 406, a universal serial bus (USB) port 408, and a battery 410. In some embodiments, the device 400 may optionally include an antenna 412, a processor 414 and a cache memory 416 that are coupled to the printed circuit board (PCB) 406, and are adapted to control one or more activities performed by the device 400. In one example, the optional elements are configured to control and adjust the amount and timing of the delivery of the light emitted by the array of light sources 402 based on a signal received through the USB port 408 or wireless signal (e.g., Bluetooth®, Bluetooth® LE, NFC, etc.) received by the antenna 412. The battery 410 may be used to power the array of light source 402 and the other components of the device 400, such as the antenna 412 formed on the PCB 406. The battery 410 may be a rechargeable battery and recharged via a cable, such as the cable 134, connected to the USB port 408 on the PCB 406. The USB port 408 may be a standard size, a micro size, or a mini size. Alternatively, other ports such as a proprietary port (not shown) may be used. The heat shield 404 may be placed between the battery 410 and the PCB 406. The device 400 may include various standard electronic modules that are well known in the art and are not described in detail herein, FIG. 5 is a cross sectional view of the first linkage 106 and the body portion 110 of the second linkage 108, illustrating the engagement mechanism between the first linkage 106 and the second linkage 108. As illustrated, the fin 128 protrudes from the inner surface of the side face 106S of the first linkage 106 in the X direction, and the fin 128' protrudes from the inner surface of the side face 106S' of the first linkage 106 in the X direction. The groove 130 is formed in the outer surface of the side face 110S of the body portion 110 of the second linkage 108 in the X direction, and the groove 130' is formed in the outer surface of the side face 110S' of the body portion 110 of the second linkage 108 in the X direction. When in use, the fin 128 engages with the groove 130, and the fin 128" engages with the groove 130', thus allowing the first linkage 106 and the body portion 110 of the second linkage 108 to slide with respect to each other in the Z direction when an external force in the Z direction is applied to one or both of the first linkage 106 and the second linkage 108, and to be held in place when no external force in the Z direction is applied.

For example, each of the fins 128, 128' may have a length of between about 50 mm and about 650 mm, such as between about 50 mm and about 300 mm, or between about 50 mm and about 210 mm, for example, about 110 mm in the Z direction (FIG. 1A), a width of about 3.5 mm in the X direction (FIG. 5), and a depth of about 0.7 mm in the Y direction (FIG. 5). Each of the grooves 130, 130' may have a length of between about 60 mm and about 680 mm, such as between about 80 mm and about 330 mm, for example, about 135 mm, in the Z direction (FIG. 1A), a width of about 0.7 mm, in the X direction (FIG. 5), and a depth about 0.7 mm in the Y direction (FIG. 5).

Figure 1G:
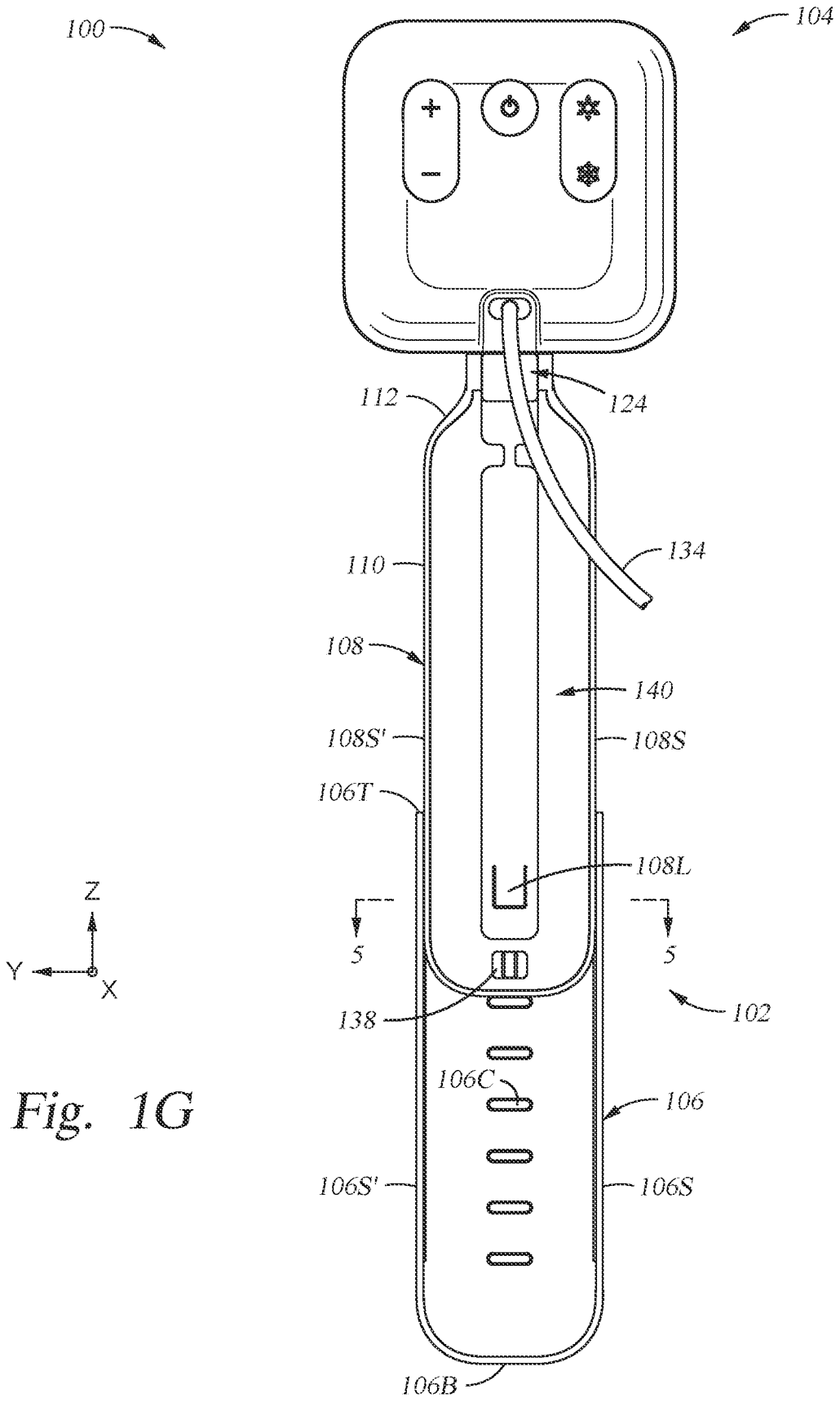
FIGS. 1G and 1H are rear views of a mountable device assembly according to one embodiment, in an extended configuration and in a fully retracted configuration, respectively.
Figure 1H:
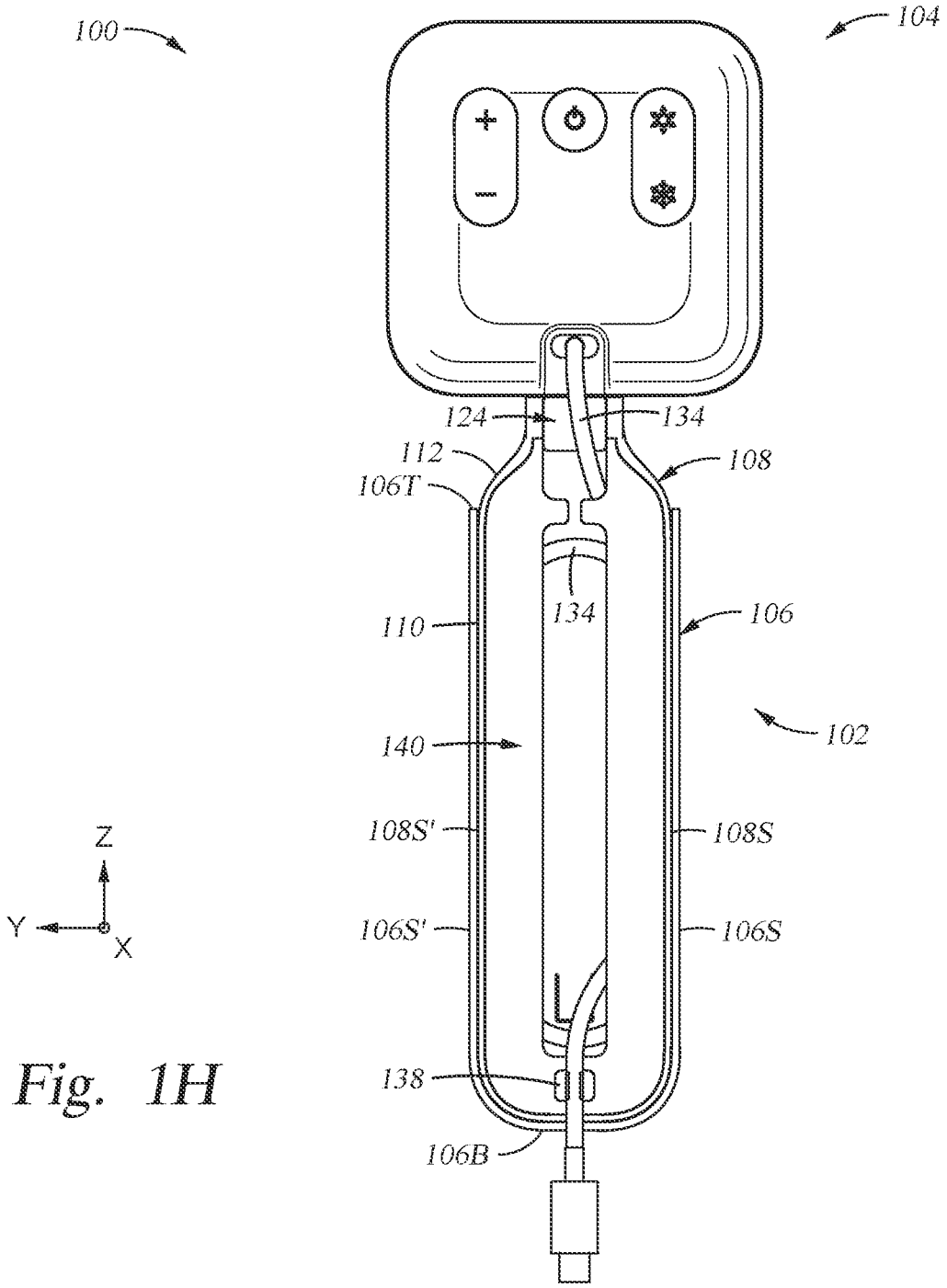

Referring to FIGS. 1B and 1E, a cable management system 132, which is a recess 136 formed on the rear face 110R of the body portion 110 of the second linkage 108, is configured such that a cable, such as the cable 134, can be rolled and stored within the recess 136. In some embodiments, the cable management system 132 includes one or more protrusions 138 on a rear cover 140, as illustrated in FIGS. 1G and 1H, such that a cable, such as the cable 134, can be snapped in the one or more protrusions 138. FIGS. 1G and 1H are rear views of the portable light 100, in an extended configuration and in a fully retracted configuration, respectively. It should be noted that the cable management system 132 is disposed on the second linkage 108, to which the housing 104 is connected. Thus, a distance between the housing 104 and the cable management system 132 is unchanged when the second linkage 108 is positioned relative to the first linkage 106 in an extended configuration, as illustrated in FIG. 1B, and in a retracted configuration, as shown in FIG. 1E. This configuration thus allows the second linkage 108 to slide in the Z direction with respect to the first linkage 106 without causing stress or tension in a portion of the cable stored in the cable management system 132 and the portion of the cable attached to the USB port 408 formed in the housing 104.

FIGS. 6A and 6B illustrate an exemplary use of the portable light 100. As illustrated, the portable light 100 is placed on a monitor display 602 (e.g., a laptop or tablet that includes a built-in display, a CRT monitor, a LED display, a LCD monitor, an OLED monitor, a plasma display monitor), by placing the third linkage 114 on a top edge 402T of the monitor display 602, the lip portion 120 of the telescoping element 118 on a front face 602F of the monitor display 602, and the bottom wall 106B of the first linkage 106 on a rear face 602R of the monitor display 602. The friction pad 106P and another friction pad (not shown) disposed on the lip portion 120 are configured to inhibit the bottom wall 106B of the first linkage 106 from sliding against the rear face 602R of the monitor display 602. Another device 604, such as a webcam, may be also placed on the monitor display 602. Thus, the housing 104 can be placed behind and above the monitor display 602. The neck portion 112 of the second linkage 108 is positioned a distance D behind the rear face 602R of the monitor display 602 (i.e., a distance between the neck portion 112 of the second linkage 108 and a plane including the front face 602F of the monitor display 602 illustrated as the dotted line), and the neck portion 112 is also positioned a height H above the top edge 602T of the monitor display 602, which can both be adjusted by adjusting: 1) the position of the body portion 110 of the second linkage 108 relative to the first linkage 106, 2) an angle $\gamma$ between the first linkage 106 and the third linkage 114, and/or 3) the position of the telescoping element 118 relative to the third linkage 114. For example, an overall length of the first linkage 106 and the body portion 110 of the second linkage 108 can range between about 118 mm and about 576 mm, and a length $L_3$ of the third linkage 114 is between about 20 mm and about 80 mm, the angle $\gamma$ between the first linkage 106 and the third linkage 114 can range between about 0° and about 90°, and an overall length L of the third linkage 114 and the telescoping element 118 can range between about 42 mm and about 66 mm. Therefore, the neck portion 112 of the second linkage 108 is positioned behind the rear face 602R of the monitor display 602. The distance D of the neck portion 112 of the second linkage 108 behind the rear face 602R of the monitor display 602 can vary between about 0 mm and about 80 mm, and the height H of the neck portion 112 of the second linkage 108 above the top edge 602T of the monitor display 602 can range between about 0 mm and about 120 mm. The monitor display 602 may have a thickness of between about 3 mm and about 62 mm.

In some embodiments, the portable light 100 can be used as a hand-held device. The first linkage 106 can be held in the hand. For a user's comfort when holding the first linkage 106, the portable light 100 may be used in an open configuration, in which the third linkage 114 extends outwardly from the front face 106F of the first linkage 106 substantially perpendicular to the front face 106F of the first linkage 106 in the X direction.

In the embodiments described herein, systems and methods for placing devices, such as portable lights and other peripherals including webcams, on a monitor display, such as a laptop or tablet that includes a built-in display, a cathode-ray tube (CRT) monitor, a light emitting diode (LED) monitor, a liquid crystal display (LCD) monitor, an organic light-emitting diode (OLED) monitor, a plasma display monitor, are provided. Mountable device assemblies according to the embodiments described herein can be location adjustable and can place a device at a desired height from the monitor display, a desired distance behind the back of the monitor display, and at a desired angle relative to the monitor display. The mountable device assemblies described herein can also be held in the hand and allows the device to be used as a hand-held device.

While the foregoing is directed to embodiments of the present disclosure, other and further embodiments of the disclosure may be devised without departing from the basic scope thereof, and the scope thereof is determined by the claims that follow.

The invention claimed is:

1. A device mount, comprising:

a first linkage having a front face that extends in a first direction and faces in a second direction that is perpendicular to the first direction, wherein the first linkage has a length in the first direction of between 100 mm and 700 mm;

a second linkage slidably connected to the first linkage, the second linkage comprising a body portion extending in the first direction and a neck portion disposed at an end of the body portion of the second linkage, wherein the body portion includes a front face that faces the second direction, and a rear face opposite to the front face in the second direction, the neck portion is inclined at an angle with respect to the front face of the body portion, wherein the angle is measured about an axis that is substantially perpendicular to the first direction, the body portion of the second linkage has a length in the first direction of between 100 mm and 720 mm, an overall length of the first linkage and the body portion of the second linkage is between 176 mm and 576 mm in a fully extended configuration in which the body portion of the second linkage is substantially extended from the first linkage, and between 118 mm and 368 mm in a fully retracted configuration in which the body portion of the second linkage is substantially retracted within the first linkage, and the second linkage is slidably connected to the first linkage via an engagement mechanism configured to slide the second linkage relative to the first linkage in the first direction between the fully extended configuration and the fully retracted configuration, the engagement mechanism including:

grooves each formed in an outer surface of one of side faces of the body portion of the second linkage; and protrusions each formed on an inner surface of one of side faces of the first linkage and engaged with one of the grooves;

a third linkage rotatably connected to the first linkage at a first end of the third linkage, wherein the third linkage extends outwardly from the front face of the first linkage;

a telescoping element slidably connected to the third linkage, the telescoping element comprising an abutment portion at an end of the telescoping element; and a housing attachment mechanism coupled to a first surface of the neck portion of the second linkage.

2. The device mount of claim 1, wherein the housing attachment mechanism is configured to attach a housing, and the housing attachment mechanism comprises a joint that is configured to allow the housing to tilt in a plane perpendicular to the second direction by a first angle and rotate along an axis perpendicular to the first surface of the neck portion of the second linkage by a second angle.

3. The device mount of claim 2, wherein the first angle is between 0° and 180°, and the second angle is up to 360°.

4. The device mount of claim 1, wherein each of the protrusions has a length of between 50 mm and 650 mm in the first direction, and each of the grooves has a length of between 60 mm and 680 mm in the first direction.

5. The device mount of claim 1, wherein:

the third linkage is rotatably connected to the first linkage via a friction hinge, and configured to rotate in a plane perpendicular to the second direction between an open configuration, in which the third linkage extends outwardly from the front face of the first linkage in the second direction, and a closed configuration, in which the third linkage extends in the first direction towards a bottom wall of the first linkage.

6. The device mount of claim 1, wherein the telescoping element comprises end tabs that are engaged with side faces of the third linkage, and is configured to slide relative the third linkage.

7. The device mount of claim 1, further comprising:

a cable management system disposed on the rear face of the body portion of the second linkage.

8. A mountable device assembly, comprising:

a device mount, comprising:

a first linkage having a front face that extends in a first direction and faces in a second direction that is perpendicular to the first direction, wherein the first linkage has a length in the first direction of between 100 mm and 700 mm;

a second linkage slidably connected to the first linkage, the second linkage comprising a body portion extending in the first direction and a neck portion disposed at an end of the body portion of the second linkage, wherein the body portion of the second linkage has a length in the first direction of between 100 mm and 720 mm, the body portion includes a front face that faces the second direction, and a rear face opposite to the front face in the second direction, the neck portion is inclined at an angle with respect to the front face of the body portion, wherein the angle is measured about an axis that is substantially perpendicular to the first direction, an overall length of the first linkage and the body portion of the second linkage is between 176 mm and 576 mm in a fully extended configuration in which the body portion of the second linkage is substantially extended from the first linkage, and between 118 mm and 368 mm in a fully retracted configuration in which the body portion of the second linkage is substantially retracted within the first linkage, and the second linkage is slidably connected to the first linkage via an engagement mechanism configured to slide the second linkage relative to the first linkage in the first direction between the fully extended configuration and the fully retracted configuration, the engagement mechanism including:

grooves each formed in an outer surface of one of side faces of the body portion of the second linkage; and protrusions each formed on an inner surface of one of side faces of the first linkage and engaged with one of the grooves;

a third linkage rotatably connected to the first linkage at a first end of the third linkage, wherein the third linkage extends outwardly from the front face of the first linkage;

a telescoping element slidably connected to the third linkage, the telescoping element comprising an abutment portion at an end of the telescoping element; and a housing attachment mechanism coupled to a first surface of the neck portion of the second linkage;

a housing disposed on the device mount via the housing attachment mechanism; and a device enclosed in the housing.

9. The mountable device assembly of claim 8, wherein the housing comprises an outer casing and a lens, and the device comprises:

one or more light sources that are configured to emit a plurality of wavelengths of light through the lens of the housing.

10. The mountable device assembly of claim 8, wherein the housing attachment mechanism is configured to attach a housing, and the housing attachment mechanism comprises a joint that is configured to allow the housing to tilt in a plane perpendicular to the second direction by a first angle and rotate along an axis perpendicular to the first surface of the neck portion of the second linkage by a second angle.

11. The mountable device assembly of claim 10, wherein the first angle is between 0° and 180°, and the second angle is up to 360°.

12. The mounted device assembly of claim 8, wherein each of the protrusions has a length of between 50 mm and 650 mm in the first direction, and each of the grooves has a length of between 60 mm and 680 mm in the first direction.

13. The mountable device assembly of claim 8, wherein:

the third linkage is rotatably connected to the first linkage via a friction hinge, and configured to rotate in a plane perpendicular to the second direction between an open configuration, in which the third linkage extends outwardly from the front face of the first linkage in the second direction, and a closed configuration, in which the third linkage extends in the first direction towards a bottom wall of the first linkage.

14. The mountable device assembly of claim 8, wherein the telescoping element comprises end tabs that are engaged with side faces of the third linkage, and is configured to slide relative the third linkage.

15. A mountable device assembly comprising:

a device mount, comprising:

a first linkage having a front face that extends in a first direction and faces in a second direction that is perpendicular to the first direction;

a second linkage slidably connected to the first linkage, the second linkage comprising a body portion extending in the first direction and a neck portion disposed at an end of the body portion of the second linkage, wherein the body portion includes a front face that faces the second direction, and a rear face opposite to the front face in the second direction, and the neck portion is inclined at an angle with respect to the front face of the body portion, wherein the angle is measured about an axis that is substantially perpendicular to the first direction;

a third linkage rotatably connected to the first linkage at a first end of the third linkage, wherein the third linkage extends outwardly from the front face of the first linkage;

a telescoping element slidably connected to the third linkage, the telescoping element comprising an abutment portion at an end of the telescoping element; and a housing attachment mechanism coupled to a first surface of the neck portion of the second linkage; and a housing disposed on the device mount via the housing attachment mechanism, wherein the mountable device assembly is configured to be temporarily attached to a display having a front face and an opposing back face by:

adjusting an overall length of the first linkage and the body portion of the second linkage;

adjusting an angle between the first linkage and the third linkage;

adjusting an overall length of the third linkage and the telescoping element;

adjusting a tilt angle and a rotational angle of the housing; and placing the abutment portion in contact with the front face of the display;

placing a bottom face of the first linkage in contact with the opposing back face of the display, and wherein the housing is disposed at a distance from a plane that is coplanar with the front face of the display in a direction towards the opposing back face from the front face of the display.

16. A device mount, comprising:

a first linkage having a front face that extends in a first direction and faces in a second direction that is perpendicular to the first direction, wherein the first linkage has a length in the first direction;

a second linkage slidably connected to the first linkage, the second linkage comprising a body portion extending in the first direction and a neck portion disposed at an end of the body portion of the second linkage, wherein the body portion includes a front face that faces the second direction, and a rear face opposite to the front face in the second direction, the neck portion is inclined at an angle with respect to the front face of the body portion, wherein the angle is measured about a third an axis that is substantially perpendicular to the first direction, the body portion of the second linkage has a length in the first direction, the first linkage and the body portion of the second linkage include a fully extended configuration in which the body portion of the second linkage is substantially extended from the first linkage, the first linkage and the body portion of the second linkage include a fully retracted configuration in which the body portion of the second linkage is substantially retracted within the first linkage, and the second linkage is slidably connected to the first linkage via an engagement mechanism configured to allow the second linkage to slide relative to the first linkage in the first direction between the fully extended configuration and the fully retracted configuration;

a third linkage rotatably connected to the first linkage at a first end of the third linkage, wherein the third linkage extends outwardly from the front face of the first linkage;

a telescoping element slidably connected to the third linkage, the telescoping element comprising an abutment portion at an end of the telescoping element; and a housing attachment mechanism coupled to a first surface of the neck portion of the second linkage.

17. The device mount of claim 16, wherein the engagement mechanism further includes:

grooves formed in the body portion of the second linkage; and protrusions formed on the first linkage and engaged with one of the grooves.

18. The device mount of claim 17, wherein the grooves are each formed in an outer surface of one of side faces of the body portion of the second linkage; and the protrusions are each formed on an inner surface of one of side faces of the first linkage.

19. The device mount of claim 16, wherein the housing attachment mechanism is configured to attach a housing, and the housing attachment mechanism comprises a joint that is configured to allow the housing to tilt in a plane perpendicular to the second direction by a first angle and rotate along an axis perpendicular to the first surface of the neck portion of the second linkage by a second angle.

20. The device mount of claim 16, wherein:

the third linkage is rotatably connected to the first linkage via a friction hinge, and configured to rotate in a plane perpendicular to the second direction between an open configuration, in which the third linkage extends outwardly from the front face of the first linkage in the second direction, and a closed configuration, in which the third linkage extends in the first direction towards a bottom wall of the first linkage.

* * * * *